US007840022B2

(12) United States Patent
Matsumura et al.

(10) Patent No.: US 7,840,022 B2
(45) Date of Patent: Nov. 23, 2010

(54) SPEAKER DEVICE

(75) Inventors: Toshiyuki Matsumura, Osaka (JP); Shuji Saiki, Nara (JP); Sawako Kano, Hyogo (JP); Mitsukazu Kuze, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/553,319

(22) Filed: Sep. 3, 2009

(65) Prior Publication Data

US 2009/0316920 A1 Dec. 24, 2009

Related U.S. Application Data

(62) Division of application No. 10/584,090, filed as application No. PCT/JP2005/007099 on Apr. 12, 2005, now abandoned.

(30) Foreign Application Priority Data

Apr. 13, 2004 (JP) ..... 2004-117590

(51) Int. Cl.
*H04R 1/20* (2006.01)

(52) U.S. Cl. ..... 381/345; 381/111

(58) Field of Classification Search ..... 381/345; 181/151

See application file for complete search history.

(56) References Cited

U.S. PATENT DOCUMENTS

| | | | | |
|---|---|---|---|---|
| 3,617,654 | A | 11/1971 | Heidrich | |
| 3,780,867 | A | 12/1973 | Zirlis | |
| 4,450,929 | A | 5/1984 | Marrs | |
| 4,657,108 | A * | 4/1987 | Ward | 181/151 |
| 5,581,621 | A | 12/1996 | Koyama et al. | |
| 6,148,088 | A * | 11/2000 | Suzuki et al. | 381/345 |
| 6,632,771 | B1 | 10/2003 | Maekawa et al. | |
| 6,716,276 | B2 | 4/2004 | Loop et al. | |
| 7,448,467 | B2 * | 11/2008 | Wright et al. | 181/149 |
| 7,477,755 | B2 * | 1/2009 | Saiki et al. | 381/349 |
| 2004/0251077 | A1 | 12/2004 | Wright et al. | |
| 2006/0153410 | A1 * | 7/2006 | Dodd | 381/334 |

FOREIGN PATENT DOCUMENTS

| | | |
|---|---|---|
| JP | 60-500645 | 5/1985 |
| JP | 3-36988 | 4/1991 |
| JP | 06-311581 | 11/1994 |
| JP | 07-284627 | 10/1995 |

(Continued)

OTHER PUBLICATIONS

Supplementary European Search Report issued Feb. 19, 2009 in the corresponding European application.

*Primary Examiner*—Curtis Kuntz
*Assistant Examiner*—Ryan Robinson
(74) *Attorney, Agent, or Firm*—Wenderoth, Lind & Ponack, L.L.P.

(57) ABSTRACT

A speaker device includes a cabinet, a speaker unit, a port, a cartridge, and an adsorbent material. The adsorbent material is disposed in the interior of the cartridge. The cartridge is a container removable from the cabinet. When the adsorbent material is deteriorated, the cartridge is replaced or the adsorbent material is reactivated, thereby making it possible to maintain, over a long period of time, the effect of physical adsorption provided by the adsorbent material.

16 Claims, 14 Drawing Sheets

FOREIGN PATENT DOCUMENTS

| | | |
|---|---|---|
| JP | 08-109497 | 4/1996 |
| JP | 2000-036992 | 2/2000 |
| JP | 3096096 | 6/2003 |
| JP | 2004-537938 | 12/2004 |
| WO | 84/03600 | 3/1984 |
| WO | 03/013183 | 2/2003 |

* cited by examiner

SPEAKER DEVICE

This application is a divisional of U.S. application Ser. No. 10/584,090, filed Jun. 22, 2006, now abandoned which is a national stage application of International application No. PCT/JP2005/007099, filed Apr. 12, 2005.

TECHNICAL FIELD

The present invention relates to a speaker device. More particularly, the present invention relates to a speaker system which performs bass reproduction using a compact speaker cabinet.

BACKGROUND ART

Conventionally, a small speaker device has a difficulty in realizing bass reproduction due to a small cabinet volume. This is because when a cabinet volume is small, the effect of an acoustic stiffness of a chamber in a cabinet is large. As a mean of easily realizing bass reproduction in the small speaker device, a speaker device, in which an activated carbon is provided in the cabinet, has been proposed (see patent document 1, for example).

FIG. 14 is a cross-sectional view illustrating a main portion of a conventional speaker device. In FIG. 14, the conventional speaker device includes a cabinet 1, a woofer 2, an activated carbon 3, a supporting member 4, a diaphragm 5, and an air tube 6. The woofer 2 is attached to the front of the cabinet 1. The activated carbon 3 is disposed in the cabinet 1 in the form of a mass or lump. The activated carbon 3 is supported by a back face, a bottom face, an upper face, and left and right side faces of the cabinet 1, as well as the supporting member 4. Small air holes for passing air are formed on an entire surface of the supporting member 4. The air tube 6 is provided to the diaphragm 5. The air tube 6 passes air between the activated carbon 3 and the woofer 2.

Described next is an operation of the aforementioned speaker device. When an electrical signal is applied to the woofer 2, a sound pressure is generated. A pressure in the cabinet 1 is changed by the sound pressure. Then, the diaphragm 5 is vibrated by the pressure which has been changed. By the vibration of the diaphragm 5, a pressure in a chamber having the activated carbon is changed. The activated carbon 3, provided in the form of a mass or lump, is supported by the supporting member 4 and the cabinet 1, and the small air holes are provided on the entire surface of the supporting member 4. Therefore, gas affected by the pressure change caused by the vibration of the diaphragm 5 is physically adsorbed into the activated carbon 3, thereby suppressing the pressure change in the cabinet 1. Note that the air tube 6 is provided so as to suppress a pressure change in a space, including the activated carbon 3, enclosed by the cabinet 1 and the diaphragm 5, the pressure change caused by changes in ambient temperature or air pressure of the speaker device.

As described above, in the conventional speaker device, the cabinet 1 equivalently operates as a larger volume cabinet. Thus, the conventional speaker device having a small cabinet is able to realize bass reproduction as if the speaker unit is provided in a large cabinet.

[Patent document 1 ] Japanese Unexamined Patent Publication No. 60-500645

The activated carbon 3 has pores, each of which has a size in the order of micrometers, formed thereon. With the pores, the activated carbon 3 physically adsorbs gas. However, when moisture, organic gas (ammonia, for example) and the like are adsorbed into the activated carbon 3, the pores formed on the activated carbon 3 are clogged by the moisture or organic gas, thereby deteriorating the effect of physical adsorption provided by the activated carbon 3. Thus, there is a problem in that the activated carbon 3 adsorbs gas such as moisture or organic gas, which causes deterioration of the activated carbon 3, thereby reducing the effect of the activated carbon 3 provided for suppressing a pressure change in the cabinet 1.

In the speaker device disclosed in the aforementioned patent document 1, the activated carbon is also provided in the air tube 6 so as to suppress deterioration of the activated carbon 3 enclosed by the cabinet 1. Specifically, because the activated carbon provided in the air tube 6 deteriorates faster than the activated carbon 3, the progression of deterioration of the activated carbon 3 can be delayed. However, once the activated carbon provided in the air tube 6 is deteriorated, deterioration of the activated carbon 3 proceeds in a similar manner to the case where no activated carbon is provided in the air tube 6. That is, in the speaker device disclosed in the aforementioned patent document 1, the progression of deterioration of the activated carbon 3 can be delayed only until the activated carbon provided in the air tube 6 is deteriorated. Thus, in the conventional speaker device, it is difficult to maintain, over a long period of time, the effect of the activated carbon 3 provided for suppressing a pressure change in the cabinet 1.

SUMMARY OF THE INVENTION

Therefore, an object of the present invention is to provide a speaker device capable of performing bass reproduction while maintaining the effect provided by an adsorbent material (activated carbon, for example) over a long period of time.

A first aspect of the present invention is directed to a speaker device comprising: a cabinet; a speaker unit attached to the cabinet; a first container removably attached to a first opening formed in the cabinet; and an adsorbent material disposed in an interior of the first container. An air hole for passing air between the interior of the first container and an interior of the cabinet is formed through the first container.

In a second aspect of the present invention based on the first aspect, the adsorbent material is an activated carbon.

In a third aspect of the present invention based on the first aspect, the speaker device further comprises: a second container removably attached to a second opening formed in the cabinet; and a deterioration prevention material disposed in an interior of the second container. An air hole for passing air between the interior of the second container and the interior of the cabinet is formed through the second container.

In a fourth aspect of the present invention based on the third aspect, the deterioration prevention material is silica gel.

In a fifth aspect of the present invention based on the third aspect, the speaker device further comprises a port for passing air between the interior and an exterior of the cabinet. The deterioration prevention material provided in the second container is disposed at a position such that the deterioration prevention material is closer to an opening which is in the interior of the cabinet and formed by the port, than the first container.

In a sixth aspect of the present invention based on the third aspect, the deterioration prevention material includes cobalt chloride, and the second container is formed such that the deterioration prevention material is capable of being seen from an exterior of the second container.

In a seventh aspect of the present invention based on the third aspect, a heat resistant temperature of the second container is higher than or equal to a boiling point of a substance adsorbed into the deterioration prevention material.

In an eighth aspect of the present invention based on the third aspect, the deterioration prevention material includes a photocatalyst.

In a ninth aspect of the present invention based on the first aspect, the speaker device further comprises: a tubular port disposed for passing air between the interior and the exterior of the cabinet; a deterioration prevention material; and a supporting member, removably attached to an interior of the port, for supporting the deterioration prevention material.

In a tenth aspect of the present invention based on the first aspect, the speaker device further comprises: a shock-absorbing member disposed at an attachment portion, of the first container, provided for attaching the first container to the cabinet; and a fixing tool, mounted on the cabinet, for removably fixing the first container thereto such that the first container presses against the cabinet through the shock-absorbing member.

In an eleventh aspect of the present invention based on the first aspect, the speaker device further comprises a shock-absorbing member disposed on an inner face of the cabinet, and a fixing tool for fixing the first container thereto such that the first container presses against the inner face of the cabinet through the shock-absorbing member.

In a twelfth aspect of the present invention based on the first aspect, the first container includes an opening and closing part for opening and closing an opening formed in the first container.

In a thirteenth aspect of the present invention based on the first aspect, the cabinet includes an opening and closing part for opening and closing the first opening, and the first container is disposed in the interior of the cabinet.

In a fourteenth aspect of the present invention based on the first aspect, a heat resistant temperature of the first container is higher than or equal to a boiling point of a substance adsorbed into the adsorbent material.

In a fifteenth aspect of the present invention based on the first aspect, the adsorbent material includes a photocatalyst.

In a sixteenth aspect of the present invention based on the first aspect, the speaker device further comprises: measurement means for measuring frequency response of an electrical impedance of the speaker unit by inputting an electrical signal to the speaker unit; and notification means for notifying that a peak value of the frequency response is shifted to a high frequency side by a predetermined frequency.

In a seventeenth aspect of the present invention based on the first aspect, the speaker device further comprises: measurement means for measuring a sound pressure frequency response of the speaker unit by inputting an electrical signal to the speaker unit; and notification means for notifying that a bass reproduction limit of the sound pressure frequency response is shifted to a high frequency side by a predetermined frequency.

An eighteenth aspect of the present invention is directed to a vehicle comprising: any of the speaker devices described in any of the above aspects, and a vehicle body with the speaker device disposed in an interior thereof.

A nineteenth aspect of the present invention is directed to a video device comprising: any of the speaker devices described in any of the first seventeen aspects, and a device housing with the speaker device disposed in an interior thereof.

According to the first aspect, a pressure change in the interior of the cabinet is suppressed by the effect of physical adsorption provided by the adsorbent material disposed in the interior of the first container. Thus, the speaker unit is able to equivalently operate as a speaker unit provided in an interior of a cabinet having a larger volume. Therefore, the speaker device having a small cabinet is able to operate as if the speaker unit is provided in a larger cabinet, thereby making it possible to extend a bass reproduction range. Furthermore, as time elapses, the adsorbent material adsorbs gas (moisture or organic gas, for example), and deteriorates. As such, by removing the first container, the adsorbent material can be replaced with another adsorbent material which has not been deteriorated, or can be reactivated. Therefore, it becomes possible to provide the speaker device capable of performing bass reproduction while maintaining the effect provided by the adsorbent material over a long period of time.

According to the second aspect, the effect of physical adsorption provided by the activated carbon allows the speaker device having a small cabinet to operate as if the speaker unit is provided in a larger cabinet. Thus, it becomes possible to extend the bass reproduction range.

According to the third aspect, the deterioration prevention material adsorbs gas which causes deterioration of the adsorbent material, thereby making it possible to suppress the deterioration of the adsorbent material. Also, a period during which the first container can be used without replacement (or a period during which no reactivation is required) can be extended. Furthermore, the deterioration prevention effect provided by the deterioration prevention material becomes reduced over time. However, by removing the second container, the deterioration prevention material can be replaced with another deterioration prevention material whose effect has not been reduced, or can be reactivated. Thus, it becomes possible to maintain, over a long period of time, the effect of extending the period during which the first container can be used without replacement (or the period during which no reactivation is required).

According to the fourth aspect, the silica gel adsorbs moisture in the interior of the cabinet, thereby suppressing the deterioration of the adsorbent material. Thus, it becomes possible to extend the period during which the first container can be used without replacement (or the period during which no reactivation is required).

According to the fifth aspect, in a bass-reflex type speaker device including the port, the deterioration prevention material is disposed at the position such that the deterioration prevention material is closer to the opening, in the interior of the cabinet, which is formed by the port, than the first container. Thus, even if gas external of the cabinet flows in from the port when the speaker device is in operation, most of the gas will pass through the deterioration prevention material. Therefore, it becomes possible to effectively prevent the gas which causes deterioration of the adsorbent material from reaching the adsorbent material.

According to the sixth aspect, when the cobalt chloride adsorbs moisture, the cobalt chloride turns from blue to red. Thus, a user can easily recognize a replacement time or a reactivation time of the deterioration prevention material. Furthermore, the user can more easily maintain a bass reproduction ability of the speaker device.

According to the seventh aspect, the second container is heated to a temperature higher than or equal to the boiling point of the substance adsorbed into the deterioration prevention material, thereby removing the substance adsorbed into the deterioration prevention material. Thus, it becomes possible to reactivate the deterioration prevention material.

According to the eighth aspect, a light is irradiated to the photocatalyst contained in the deterioration prevention material, thereby decomposing the substance adsorbed into the deterioration prevention material. Thus, it becomes possible to reactivate the deterioration prevention material.

According to the ninth aspect, in a bass-reflex type speaker device including the port, the supporting member supports the deterioration prevention material, and is removably attached to the interior of the port. Even if gas external of the cabinet flows in from the port when the speaker device is in operation, most of the gas will pass through the deterioration prevention material. Thus, it becomes possible to effectively prevent the gas which causes deterioration of the adsorbent material from reaching the adsorbent material. Furthermore, by using the port, there is no need to form a new opening in the cabinet so as to allow the supporting member to be removable, thereby making it possible to simplify a structure of the speaker device.

According to the tenth aspect, the fixing tool allows the first container to be fixed through the shock-absorbing member so as to press against the cabinet, thereby making it possible to prevent air leakage at the attachment portion of the first container. As a result, it becomes possible to suppress distortion in reproduced sound, which is caused by the air leakage. Furthermore, when the speaker device is in operation, the elastic body controls vibration of the first container. Thus, it becomes possible to suppress the resonance of the first container.

According to the eleventh aspect, the fixing tool allows the first container to be fixed through the shock-absorbing member so as to press against the inner face of the cabinet. Thus, when the speaker device is in operation, the shock-absorbing member controls the vibration of the first container, thereby making it possible not to produce a noise.

According to the twelfth aspect, the adsorbent material can be inserted into and extracted from the first container. Thus, the first container itself can be reused without being replaced, thereby making it possible to save resources.

According to the thirteenth aspect, the first container can be inserted into and extracted from the interior of the cabinet. Thus, it is not necessary for the first container to have a structure removable from the first opening, thereby making it possible to simplify a structure of the first container.

According to the fourteenth aspect, the first container is heated to a temperature higher than or equal to the boiling point of the substance adsorbed into the adsorbent material, thereby removing the substance adsorbed into the adsorbent material. Thus, it becomes possible to reactivate the adsorbent material.

According to the fifteenth aspect, a light is irradiated to the photocatalyst contained in the adsorbent material, thereby decomposing the substance adsorbed into the adsorbent material. Thus, it becomes possible to reactivate the adsorbent material.

According to the sixteenth aspect, the frequency response of the electrical impedance is measured. Thus, it becomes possible to notify a user of the deterioration of the adsorbent material.

According to the seventeenth aspect, the sound pressure frequency response is measured. Thus, it becomes possible to notify a user of the deterioration of the adsorbent material.

According to the eighteenth aspect, it becomes possible to provide the vehicle with the speaker device disposed in the interior thereof.

According to the nineteenth aspect, it becomes possible to provide the video device with the speaker device disposed in the interior thereof.

DESCRIPTION OF THE REFERENCE CHARACTERS

Figure 1:
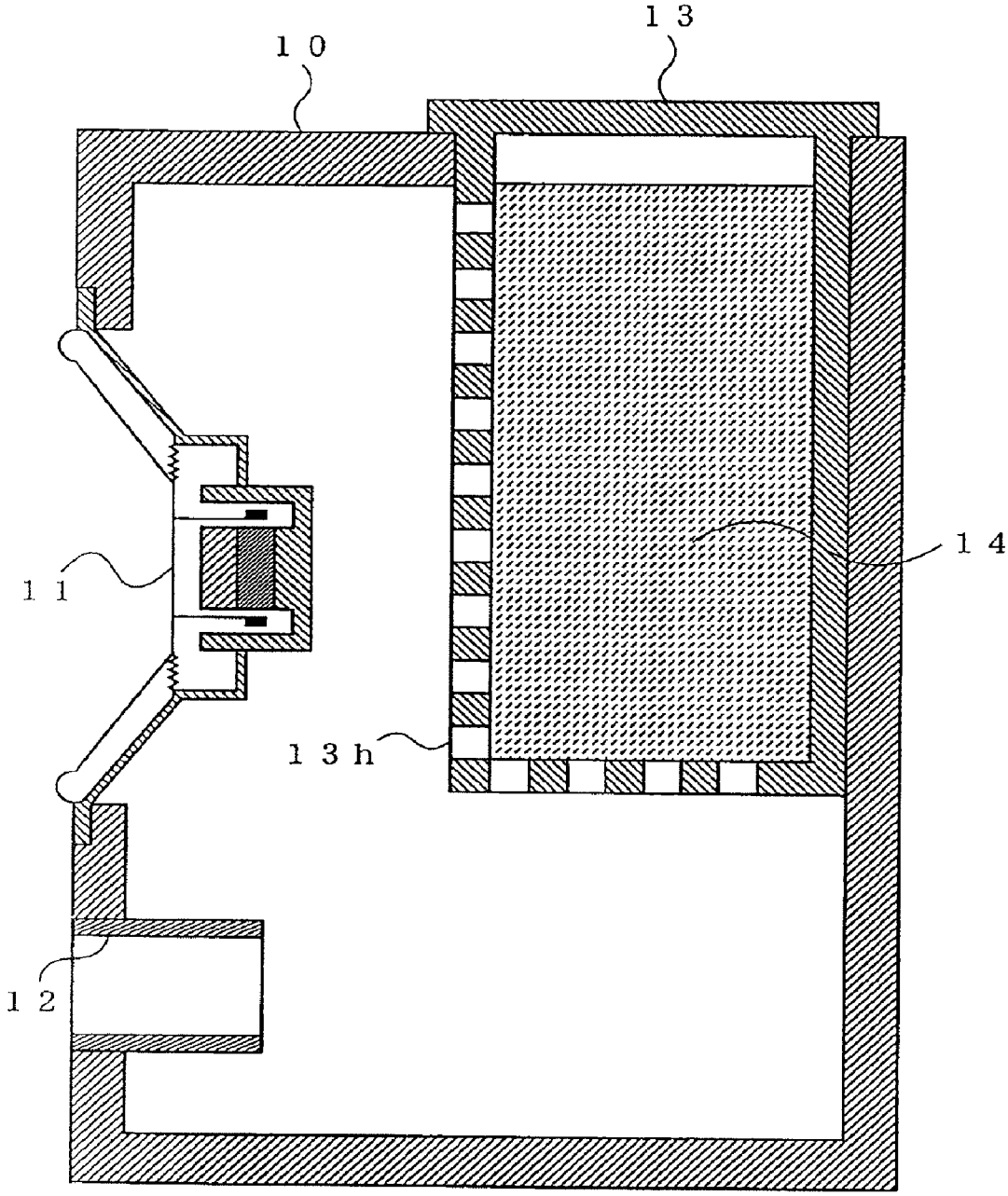
FIG. 1 is a cross-sectional view illustrating a structure of a speaker device according to a first embodiment.

10, 21, 30, 40, 60, 73 cabinet
11, 52, 61, 75 speaker unit
12 port
13, 16, 19, 20, 54, 64, 74 cartridge
14 adsorbent material
15, 106 fixing tool
17, 104, 105, 162 elastic body
18 screw
22, 24 deterioration prevention material cartridge
23, 241 deterioration prevention material
25 container
31, 41 deterioration detection device
50 window part
51 door body
53, 62, 103, 201 opening and closing part
63 base
70 slim television body
71 display
72 speaker device
151 hook
152 lever
153 first shaft
154 second shaft
161 claw part
242 projection part

311, 411 measurement means

312, 412 notification means

413 microphone

DETAILED DESCRIPTION OF THE INVENTION

First Embodiment

A speaker device according to a first embodiment of the present invention will be described with reference to FIG. 1. FIG. 1 is a cross-sectional view illustrating a structure of a speaker device according to the first embodiment. In FIG. 1, the speaker device includes a cabinet 10, a speaker unit 11, a port 12, a cartridge 13, and an adsorbent material 14.

The speaker unit 11 is attached to an opening formed in the front face of the cabinet 10. The port 12 has a tubular shape, and is attached to the cabinet 10. Also, the port 12 passes air between the interior and the exterior of the cabinet 10. The speaker device according to the present embodiment is a bass-reflex type speaker device using an acoustic load provided by the port 12.

The cartridge 13 is a container removable from the cabinet 10. Also, the cartridge 13 is inserted into an opening formed in the upper face of the cabinet 10. A plurality of air holes 13*h* for passing air between the interior and the exterior of the cartridge 13 are formed through the cartridge 13. That is, the air holes 13*h* pass air between the interior of the cabinet 10 and the interior of the cartridge 13.

The adsorbent material 14 is disposed in the interior of the cartridge 13. The adsorbent material 14 is a porous material which physically adsorbs gas, and is activated carbon, for example. The porous material can physically adsorb gas with pores, each of which has a size in the order of micrometers. As other examples of the porous materials, carbon nonotube, fullerene and the like can be used.

Described next is an operation of the speaker device according to the present embodiment. When an electrical signal is applied to the speaker unit 11, a diaphragm of the speaker unit 11 vibrates. A pressure change in the cabinet 1 occurs by the vibration of the diaphragm. However, the pressure change in the cabinet 10 is suppressed by the effect of physical adsorption provided by the adsorbent material 14 which is disposed in the cartridge 13. Thus, the speaker unit 11 equivalently operates as a speaker unit provided in the cabinet 10 having a large volume. As a result, the aforementioned speaker device having a small cabinet operates as if the speaker unit is provided in a large cabinet, thereby making it possible to extend a bass reproduction range.

As time elapses, the adsorbent material 14 adsorbs gas, in the outside air, such as moisture or organic gas (ammonia, for example), which causes deterioration of the adsorbent material 14, and then deteriorates. In practice, moisture converted to water is adsorbed into the adsorbent material 14. Also, organic gas converted to an organic substance is adsorbed into the adsorbent material 14. When the adsorbent material 14 is deteriorated, the cartridge 13 is removed from the cabinet 10 so as to be replaced with another new cartridge 13. As described above, in the speaker device according to the present embodiment, the adsorbent material 14 is disposed in the interior of the cartridge 13 so as to be replaceable, whereby reproduction can be performed while the adsorbent material 14 exerts its effect over a long period of time.

The above description illustrates an example where the cabinet 10 is a bass-reflex type. However, the cabinet 10 may be a closed enclosure type or a drone cone type. Furthermore, the cartridge 13 may be removably attached to a face other than the upper face of the cabinet 10 (a back face, for example).

Furthermore, the above description illustrates an example where when the adsorbent material 14 is deteriorated, the cartridge 13 is to be replaced with another new cartridge. However, the adsorbent material 14 which has been deteriorated may be reactivated. For example, there are the following two processing methods for reactivation. A first processing method is a method for heating the cartridge 13. Generally, by heating a porous material to a boiling point of a substance adsorbed into the porous material, the substance adsorbed into the porous material can be removed. The first method is effective in the case where a substance having a low boiling point (water, for example) is adsorbed into a porous material. For example, in the case where the adsorbent material 14 adsorbs moisture and then deteriorates, the cartridge 13 is removed from the cabinet 10 and heated in a microwave oven or the like at a temperature of approximately 110° C. for a fixed time period. Thus, water adsorbed into the adsorbent material 14 is to be evaporated. That is, moisture is to be removed from the adsorbent material 14. By reattaching the cartridge 13 including the adsorbent material 14, which is reactivated by removing the moisture, to the cabinet 10, a bass reproduction ability of the speaker device can be maintained. Note that it is preferable that the cartridge 13 be made of a material or structure which can be heated in a microwave oven, for example. Furthermore, it is preferable that a heat resistant temperature of the cartridge 13 be higher than or equal to a boiling point of a substance adsorbed into a porous material.

A second processing method is a method for reactivating the adsorbent material 14 containing a titanium oxide as a photocatalyst. Specifically, a light having a wavelength range within which a photocatalytic reaction occurs (ultraviolet rays, for example), is irradiated to the cartridge 13 including the adsorbent material 14, which contains the titanium oxide. Thus, an organic substance adsorbed into the adsorbent material 14 can be decomposed. In this case, in order to irradiate the light to the adsorbent material 14, the cartridge 13 is made of a light permeable material (a transparent material, for example). As described above, in the aforementioned first and second processing methods, for example, the adsorbent material 14 is reactivated while being kept in the cartridge 13, thereby making it possible to reuse the cartridge 13 and the adsorbent material 14.

Figure 2:
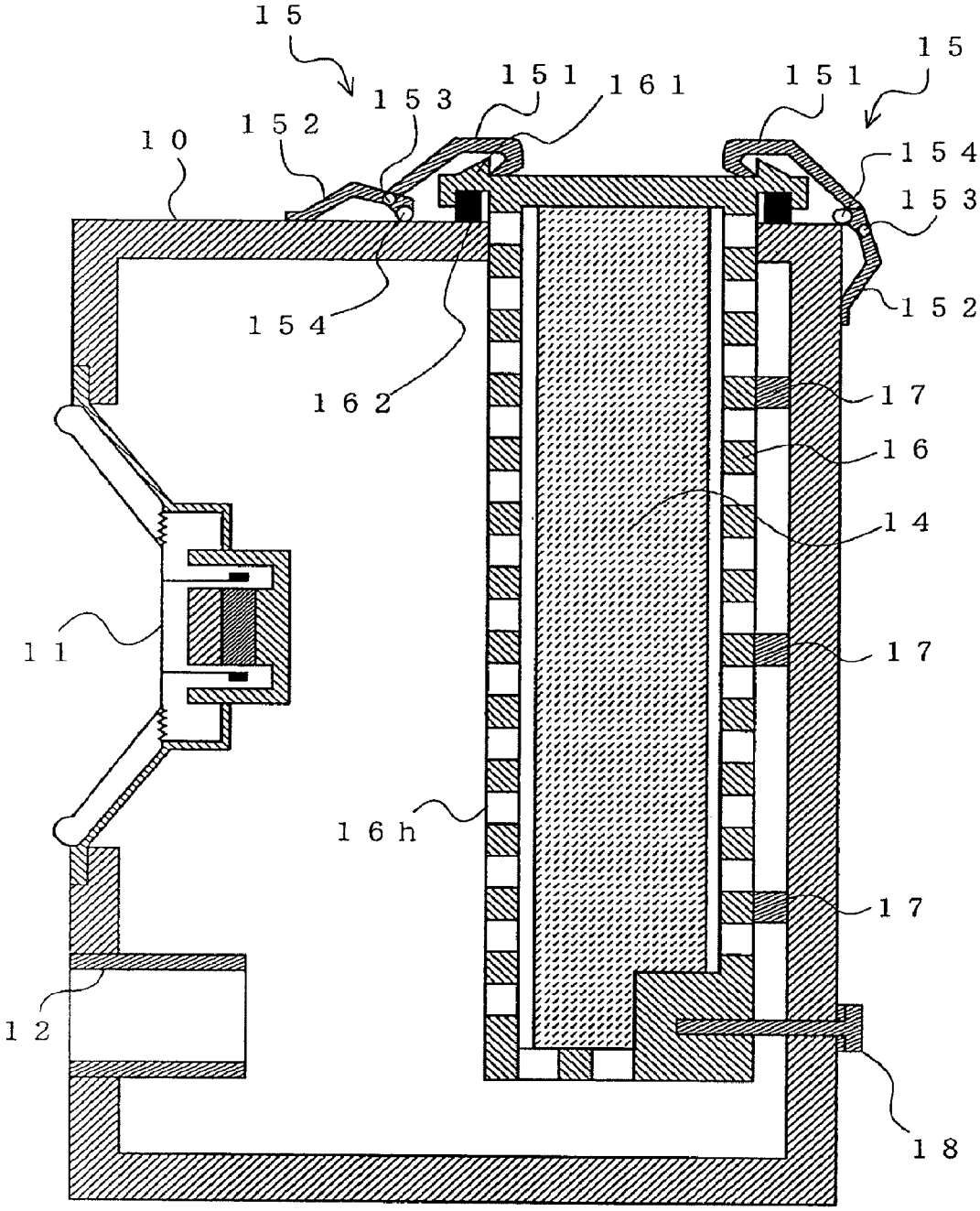
FIG. 2 is a cross-sectional view illustrating a structure of a speaker device to which a cartridge 16 is attached.

Note that a structure of the cartridge 13 is not limited to that of the cartridge 13 shown in FIG. 1. The structure of the cartridge 13 may be different. Hereinafter, other exemplary structures of the cartridge 13 will be described. A first exemplary structure is a cartridge 16 attached to the cabinet 10 by means of fixing tools 15 shown in FIG. 2, for example. FIG. 2 is a cross-sectional view illustrating a structure of a speaker device to which the cartridge 16 is attached.

In FIG. 2, the speaker device further includes the fixing tools 15, elastic bodies 17, and a screw 18. The cartridge 16 is removably mounted to an opening formed in the upper face of the cabinet 10. A plurality of air holes 16*h* for passing air between the interior of the cabinet 10 and the interior of the cartridge 16 are formed through the cartridge 16. Claw parts 161 for engaging hooks 151 of the fixing tools 15 are formed on the upper portion of the cartridge 16 (the exterior of the cabinet). Furthermore, the elastic body 162 (a rubber or foamed polyurethane, for example) is disposed at an attachment portion, of the cartridge 16, provided for attaching the cartridge 16 to the cabinet 10. The elastic body 162 has a sheet-like shape, for example.

Each of the fixing tools 15 is an appliance for fixing the cartridge 16 to the cabinet 10, by utilizing the principle of leverage, so as to press against the cabinet 10 through the elastic body 162. In FIG. 2, each of the fixing tools 15 includes a hook 151, a lever 152, a first shaft 153, and a second shaft 154. The hook 151 is rotatable about the first shaft 153. Also, the hook 151 is formed so as to engage the claw part 161 provided with the cartridge 16. The lever 152 is rotatable about the second shaft mounted on the cabinet 10. Also, the lever 152 has the first shaft mounted therein. In a method for fixing the fixing tool 15 to the cabinet 10, the hook 151 is engaged to the claw part 161 of the cartridge 16, firstly. Then, the lever 152 is rotated in a direction of pressing against the cabinet 10. Thus, the fixing tool 15 can fix the cartridge 16 to the cabinet 10 so as to press the cartridge 16 against the cabinet 10. Furthermore, when the fixing tools 15 are fixed to the cabinet 10, the elastic body 162 is pressed against the cabinet 10, thereby making it possible to prevent air leakage at a portion at which the cartridge 16 and the opening formed in the upper face of the cabinet 10 contact each other. As a result, it becomes possible to suppress distortion in reproduced sound, which is caused by the air leakage. Furthermore, when the speaker device is in operation, the elastic bodies 162 controls vibration of the cartridge 16, thereby making it possible to suppress the resonance of the cartridge 16. As described above, the elastic bodies 162 are shock-absorbing members operable to prevent air leakage at the portion at which the cartridge 16 and the opening formed in the upper face of the cabinet 10 contact each other, and to control the vibration of the cartridge 16.

The elastic bodies 17 are disposed between the cartridge 16 and the inner back face of the cabinet 10. The screw 18 fixes the cartridge 16 via a screw hole formed through the back face of the cabinet 10. In this case, the cartridge 16 having a force applied thereto, by the screw 18, in a direction of the back face of the cabinet 10, is fixed so as to press against the back face of the cabinet 10 through the elastic bodies 17. Thus, when the speaker device is in operation, the vibration of the cartridge 16 is controlled by means of the elastic bodies 17 so as not to produce a noise. As described above, the elastic bodies 17 are shock-absorbing members operable to control the vibration of the cartridge 16.

The above description illustrates an example where the fixing tools 15 are appliances for fixing the cartridge 16 to the cabinet 10 by utilizing the principle of leverage. However, other fixing tools may be used. For example, the cartridge 16 may be attached to the cabinet 10 by a screw. Alternatively, instead of the screw 18, a fixing tool to which the principle of leverage is applied may be used.

Figure 3:
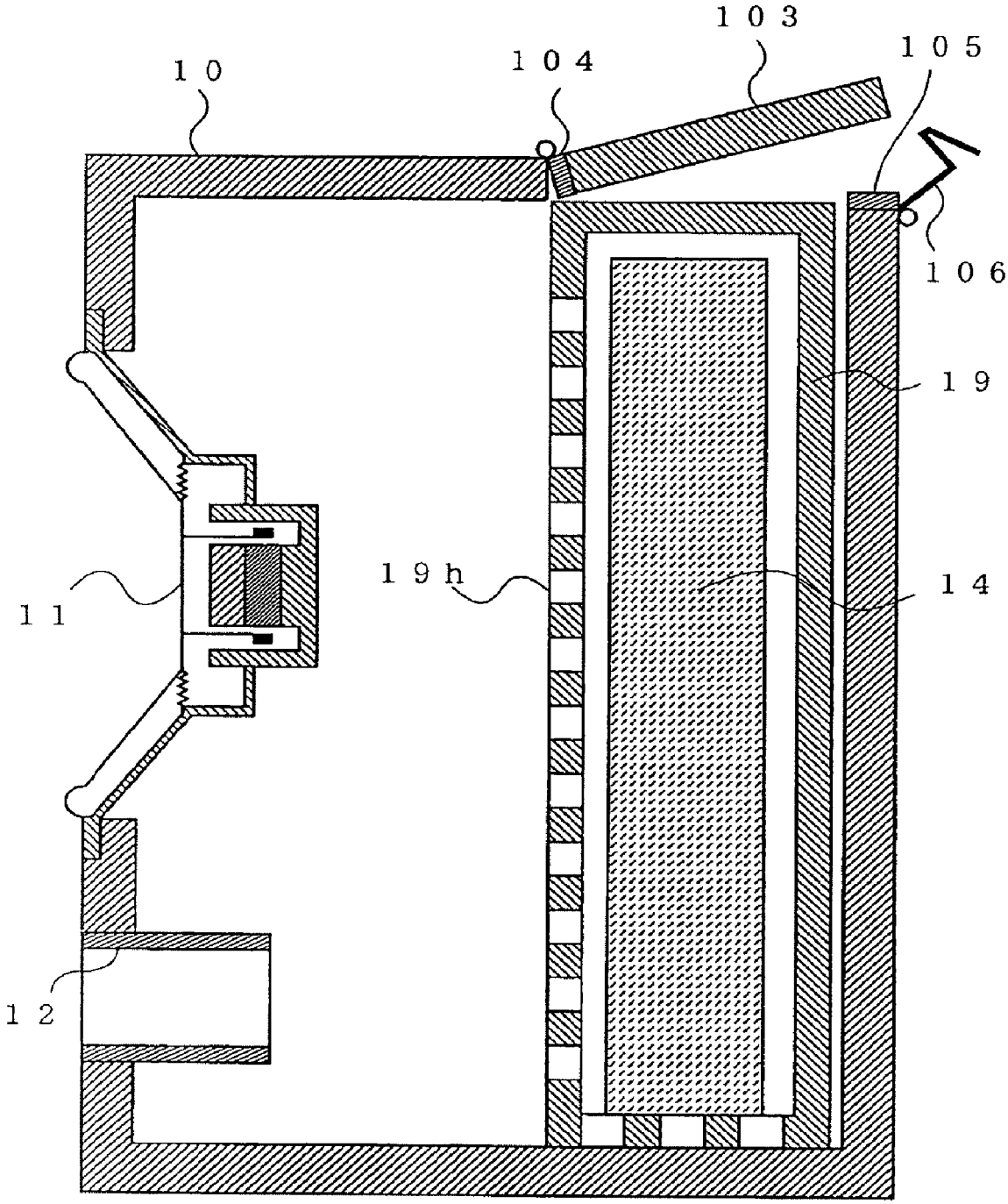
FIG. 3 is a cross-sectional view illustrating a structure of a speaker device to which a cartridge 19 is attached.

A second exemplary structure is, as shown in FIG. 3, a cartridge 19 attached to the cabinet 10 by a fixing tool 106. FIG. 3 is a cross-sectional view illustrating a structure of a speaker device to which the cartridge 19 is attached. In FIG. 3, the cabinet 10 includes an opening and closing part 103, an elastic body 104, an elastic body 105, and the fixing tool 106. The cartridge 19 is a container insertable into and extractable from the interior of the cabinet 10. A plurality of air holes **19*h* for passing air between the interior of the cabinet 10 and the interior of the cartridge 19 are formed through the cartridge 19. The opening and closing part 103 is rotatably attached to the cabinet 10 so as to open and close the opening formed in the upper face of the cabinet 10. In the case where the cartridge 19 is replaced, the opening and closing part 103 is opened so as to remove the cartridge 19 from the interior of the cabinet 10. The fixing tool 69 is rotatably attached to the cabinet 10. The fixing tool 69 is an appliance for fixing the opening and closing part 103 when the opening and closing part 103 is closed. The elastic bodies 104 and 105 are respectively disposed, when the opening and closing part 103 is closed, at portions at which the opening formed in the upper face of the cabinet 10 and the opening and closing part 103 contact each other. Thus, according to the second structure, the opening and closing part 103 is provided, thereby making it possible to allow the cartridge 19 to be inserted into and extracted from the interior of the cabinet 10. Furthermore, the opening and closing part 103 is provided, whereby it is not necessary for the cartridge 19** to have a complicated structure, similar to the first exemplary structure, in order to prevent air leakage, thus making it possible to simplify the structure of the cartridge.

Figure 4:
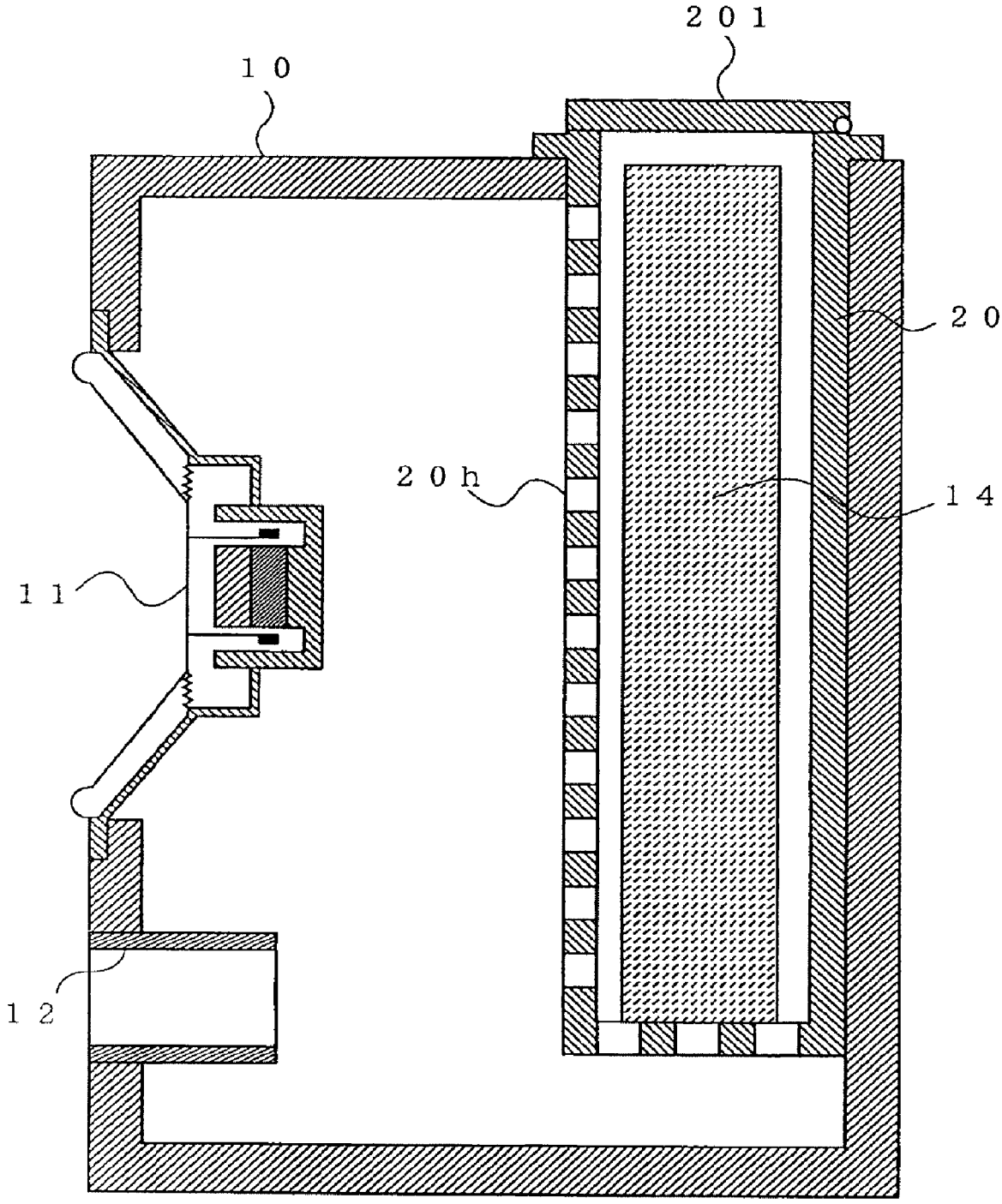
FIG. 4 is a cross-sectional view illustrating a structure of a speaker device to which a cartridge 20 is attached.

A third exemplary structure is, as shown in FIG. 4, a cartridge 20 having a cartridge opening and closing part 201. FIG. 4 is a cross-sectional view illustrating the structure of a speaker device to which the cartridge 20 is attached. The cartridge 20 is removably attached to an opening formed in the upper face of the cabinet 10. The cartridge opening and closing part 201 is provided on the upper portion of the cartridge 20 contacting the exterior of the cabinet 10. The cartridge opening and closing part 201 is rotatably attached to the cartridge 20. Thus, by opening and closing the cartridge opening and closing part 201, the adsorbent material 14 can be inserted into and extracted from the cartridge 20. In the case where the adsorbent material 14 is deteriorated, the cartridge 20 is removed from the cabinet 10. Then, the adsorbent material 14 is removed from the cartridge 20 so as to be reactivated or replaced with another new adsorbent material 14. Thus, according to the third structure, the cartridge 20 itself can be reused without being replaced, thereby making it possible to save resources. Furthermore, a position for mounting the cartridge opening and closing part 201 is not particularly limited. However, when the cartridge opening and closing part 201 is in a position which contacts the exterior of the cabinet 10, it is particularly effective because the adsorbent material 14 can be removed from the cartridge 20 being attached to the cabinet 10.

Second Embodiment

Figure 5:
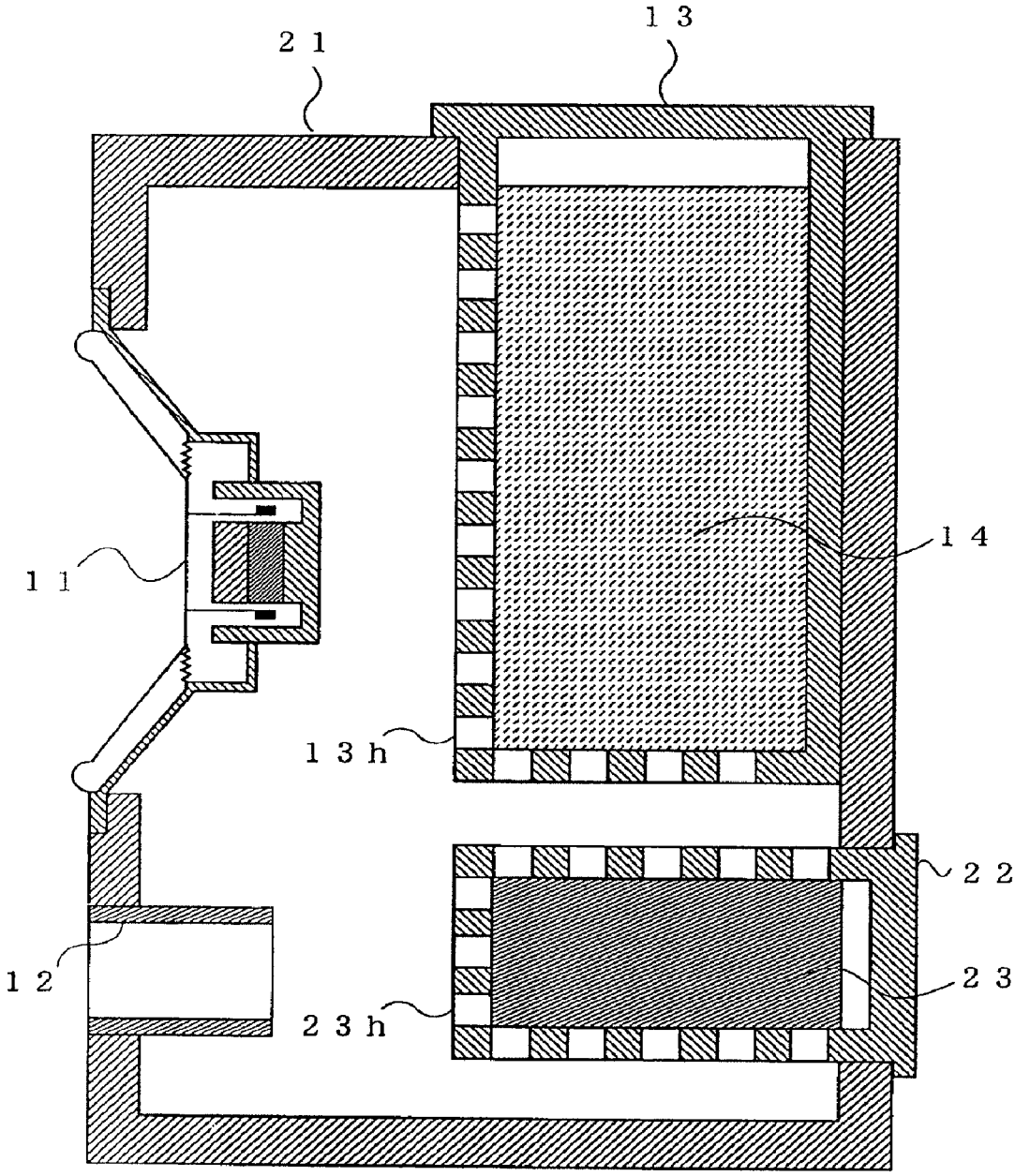
FIG. 5 is a cross-sectional view illustrating a structure of a speaker device according to a second embodiment.

A speaker device according to a second embodiment of the present invention will be described with reference to FIG. 5. FIG. 5 is a cross-sectional view illustrating a structure of a speaker device according to the second embodiment. In FIG. 5, the speaker device includes a cabinet 21, the speaker unit 11, the port 12, the cartridge 13, the adsorbent material 14, a deterioration prevention material cartridge 22, and a deterioration prevention material 23. The speaker unit 11, the port 12, the cartridge 13, and the adsorbent material 14 have the same functions as the respective elements described in the first embodiment. Thus, like reference numerals will be denoted and detailed descriptions there of will be omitted. The speaker device of the present embodiment is different from the speaker device of the first embodiment described above in that the speaker device of the present embodiment further includes the deterioration prevention material cartridge 22 and the deterioration prevention material 23. Hereinafter, the present embodiment will be described mainly with respect to this difference.

Similarly to the cartridge 13, the deterioration prevention material cartridge 22 is a container removable from the cabinet 10. Also, the deterioration prevention material cartridge 22 is the container removable from an opening formed in the back face of the cabinet 21. A plurality of air holes **23*h* for passing air between the interior of the deterioration prevention material cartridge 22 and the interior of the cabinet 10 are formed through the deterioration prevention material cartridge 22**.

The deterioration prevention material 23 is disposed in the interior of the deterioration prevention material cartridge 22. The deterioration prevention material 23 is made from a material operable to adsorb gas which causes deterioration of the activated body 14. That is, the deterioration prevention material 23 adsorbs moisture, organic gas, and the like, in the interior of the cabinet 21. A drying agent, a material that removes the organic gas (hereinafter, referred to as a removal agent) and the like are used as the deterioration prevention material 23. As the drying agent, silica gel is used, for example. As the removal agent, activated carbon, zeolite, diatomite, chitosan, and catechin are used, for example. The drying agent and the removal agent may be mixed to be used.

Described next is an operation of the speaker device according to the present embodiment. Similarly to the first embodiment described above, the cartridge 13 enables the speaker device to extend the bass reproduction range. The deterioration prevention material 23 is disposed in the interior of the cabinet 21. Then, the deterioration prevention material 23 adsorbs moisture or organic gas in the interior of the cabinet 21. Thus, the moisture or organic gas in the interior of the cabinet 10 are removed by means of the deterioration prevention material 23, thereby making it possible to suppress deterioration of the adsorbent material 14. Thus, it becomes possible to extend a period during which the cartridge 13 can be used without replacement. The deterioration prevention effect provided by the deterioration prevention material 23 becomes reduced over time. In such a case, the deterioration prevention material cartridge 22 is removed from the cabinet 21 so as to be replaced with another new deterioration prevention material cartridge 22. Thus, it becomes possible to maintain, over a long period of time, the effect of preventing the adsorbent material 14 from deteriorating and the effect of extending the period during which the cartridge 13 can be used without replacement.

As described above, in the speaker device according to the present embodiment, the deterioration prevention material 23 which can be replaced by the deterioration prevention material cartridge 22 is provided, thereby making it possible to suppress the deterioration of the adsorbent material 14. Furthermore, as compared to the speaker device of the first embodiment, the speaker device of the present embodiment is able to extend the period during which the cartridge 13 can be used without replacement, and to maintain, over a long period of time, the effect of extending the period during which the cartridge can be used without replacement.

Figure 6:
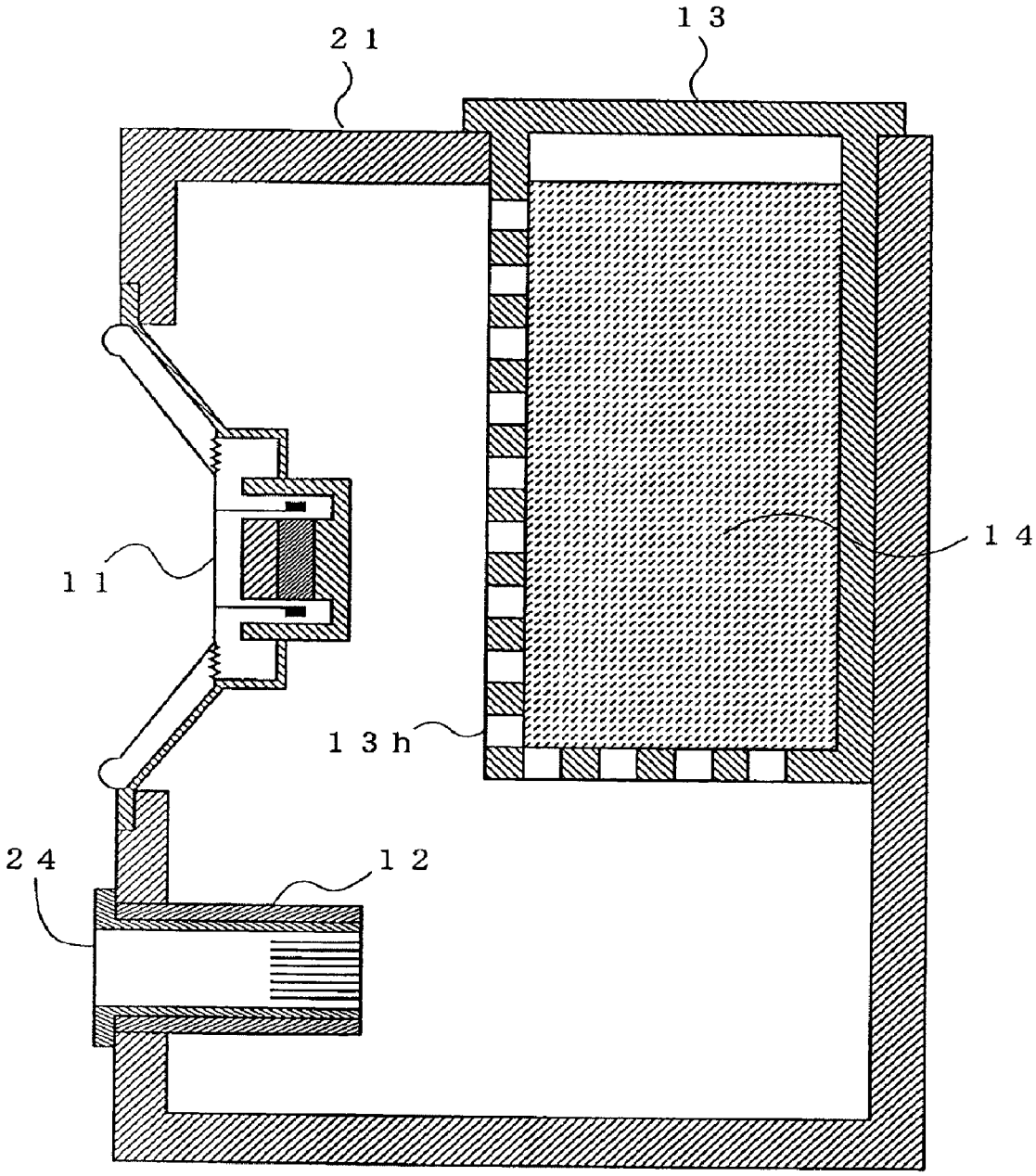
FIG. 6 is a cross-sectional view illustrating the structure of the speaker device, according to the second embodiment, to which a deterioration prevention material cartridge 24 is attached.
Figure 7:
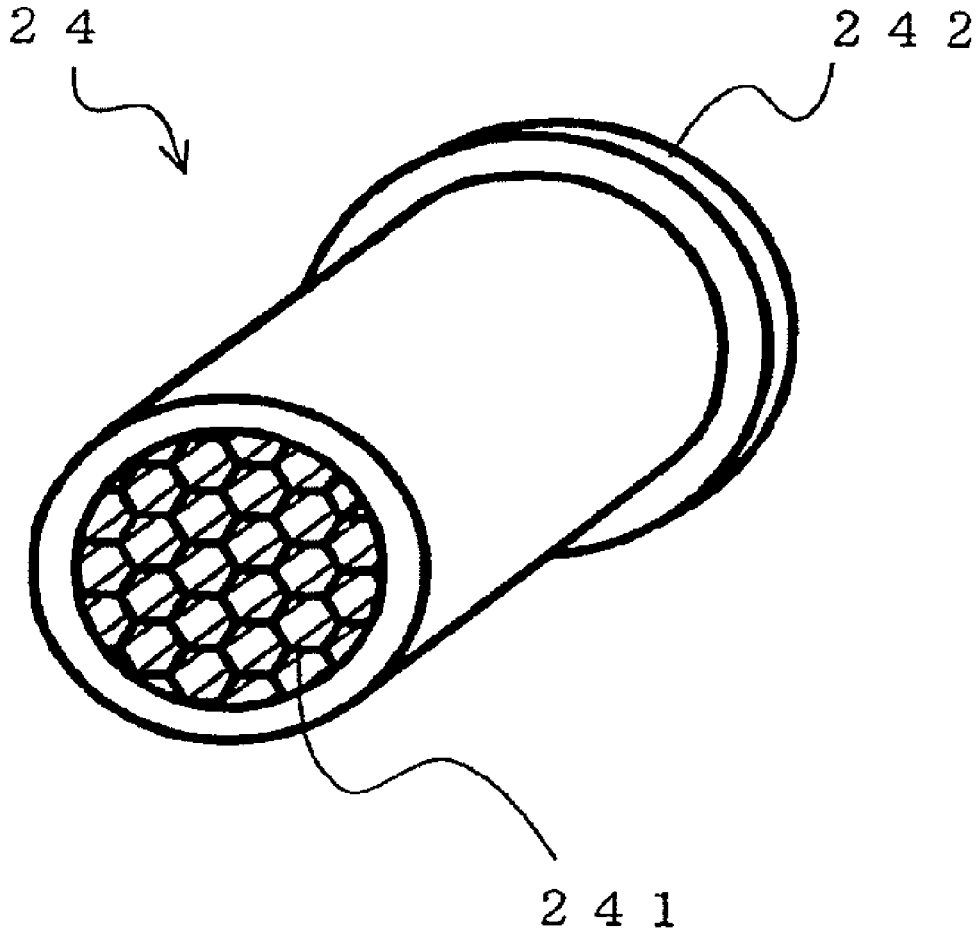
FIG. 7 is a perspective view illustrating the deterioration prevention material cartridge 24.

Note that the cartridge 13 and the deterioration prevention material cartridge 22 may have the first to third exemplary structures described in the first embodiment, respectively. The above description illustrates an example where the cabinet 10 is a bass-reflex type. However, the cabinet may be a closed enclosure type or a drone cone type. In the case where the speaker device is a bass-reflex type having a port, the deterioration prevention material cartridge 22 may be used as the deterioration prevention material cartridge 24 shown in FIG. 6 and FIG. 7. FIG. 6 is a cross-sectional view illustrating the structure of the speaker device, according to the second embodiment, to which the deterioration prevention material cartridge 24 is attached. FIG. 7 is a perspective view illustrating the deterioration prevention material cartridge 24.

The deterioration prevention material cartridge 24 is formed to be removable from the interior of the port 12. In FIG. 7, the deterioration prevention material cartridge 24 has a nearly cylindrical shape. A deterioration prevention material 241 formed in a honeycomb shape is supported in the interior of the cylindrical shape and at one end of the prevention body cartridge 24. Thus, the deterioration prevention material cartridge 24 is a supporting member for supporting the deterioration prevention material 241. Note that due to fluctuations of sound pressure generated when the speaker device is in operation, gas flows into and out of the interior of the port 12. A ventilation resistance of the honeycomb shape is set to be low so as to prevent the port 12 from producing a noise by the gas flowing into and out of the port 12. As an example of setting the ventilation resistance to be low, each mesh of the honeycomb shape may be set to be larger so as to increase an aperture area thereof. Furthermore, a projection part 242 protruded in the outer peripheral direction of the cylindrical shape, is formed around the outer peripheral surface of the cylindrical shape and at the other end of the deterioration prevention material cartridge 24. Note that an outer diameter of the projection part 242 is set to be larger than an inner diameter of the opening provided by the port 12.

In FIG. 6, the deterioration prevention material cartridge 24 is removably mounted to the opening provided by the port 12 such that the projection part 242 faces toward the front of the cabinet 21. Thus, the deterioration prevention material cartridge 24 is inserted into the opening provided by the port 12, whereby most of the gas flowing into the interior of the cabinet 21 from the port 12 when the speaker device is in operation will pass through the deterioration prevention material 241. As a result, the deterioration prevention material 241 can effectively remove the gas, which causes deterioration of the adsorbent material 14. Furthermore, because the deterioration prevention material cartridge 24 is removably mounted by using the opening provided by the port 12, there is no need to form a new opening in the cabinet 21, thereby making it possible to simplify a structure of the speaker device.

The above description illustrates an example where the deterioration prevention material cartridge 24 has a cylindrical shape. However, the present invention is not limited thereto. The deterioration prevention material cartridge 24 may be formed to be removable from the opening provided by the port 12. Alternatively, for example, a screw thread is cut on the outer periphery of the cylindrical shape of the deterioration prevention material cartridge 24 and on the inner periphery of the port 12. Then, the deterioration prevention material cartridge 24 may be rotated in a screw direction so as to fix to the port 12. By cutting the screw thread for fixing the deterioration prevention material cartridge 24 to the port 12, the deterioration prevention material cartridge 24 can be more securely fixed to the port 12. Thus, when the speaker device is in operation, it becomes possible to suppress a noise produced by vibration of the deterioration prevention material cartridge 24. Furthermore, in the present embodiment, the deterioration prevention material 241 is formed in a honeycomb shape. However, the present invention is not limited thereto. The deterioration prevention material 241 may be formed to have a low ventilation resistance to the port 12, and to effectively adsorb gas which causes deterioration of the adsorbent material 14. Furthermore, the deterioration prevention material 241 may be provided at a position at which the deterioration prevention material cartridge 24 is removable from the port 12, and through which gas flowing into and out of the port 12 can pass. Therefore, for example, if the deterioration prevention material 241 is provided in the interior of the deterioration prevention material cartridge 24, the deterioration prevention material 241 may be supported at the other end (on the side of the projection part 242) of the deterioration prevention material cartridge 24. Furthermore, if the deterioration prevention material 241 is removable from the port 12, the deterioration prevention material 241 may be supported at a position other than the interior of the deterioration prevention material cartridge 24.

In the case where a drying agent is used as the deterioration prevention material 23, the drying agent may contain cobalt chloride. A characteristic of the cobalt chloride is that when the cobalt chloride is dry, the cobalt chloride is blue; and when the cobalt chloride adsorbs moisture, the cobalt chloride forms a hydrate and turns into red. In this case, the deterioration prevention material cartridge 22 has a structure such that a user can recognize changes in the color of the deterioration prevention material 23 from the exterior of the cabinet 21. For example, a portion of the deterioration prevention material cartridge 22 contacting the exterior of the cabinet 21 is made transparent. Thus, it becomes possible to allow the user to easily recognize a replacement time of the deterioration prevention material 23. Furthermore, it becomes easier to maintain the bass reproduction ability of the speaker device.

The above description illustrates an example where the deterioration prevention material cartridge 22 is replaced with a new cartridge when the effect provided by the deterioration prevention material 23 is reduced. However, in the case where the drying agent is used as the deterioration prevention material 23, the present invention is not limited thereto. For example, similarly to the first embodiment described above, the drying agent may be reactivated. By using a heat-resistant container as the deterioration prevention material cartridge 22 and heating the container, the drying agent is reactivated. When being heated, a granular drying agent and the like will be scattered. Thus, by heating the drying agent while being kept in the deterioration prevention material cartridge 22, it becomes possible to prevent the drying agent from being scattered. In other words, safety during the reactivation process is improved.

Furthermore, the drying agent may be disposed so as to be positioned in the vicinity of the port 12 in the interior of the cabinet 21. Thus, even if gas external of the cabinet 21 flows in from the port 12 when the speaker device is in operation, most of the gas will pass through the drying agent, thereby making it possible to effectively prevent moisture in the gas from reaching the adsorbent material 14.

Similarly to the aforementioned first embodiment, in the case where a removal agent for adsorbing organic gas is used as the deterioration prevention material 23, the removal agent may be reactivated, for example. By irradiating a light to the removal agent containing a photocatalyst, the removal agent is reactivated. In this case, each of the deterioration prevention material cartridges 22 and 24 is made of a light permeable material (a transparent material, for example) such that the removal agent is irradiated with a light.

Furthermore, the degree of adsorption of the removal agent is equivalent to that of the adsorbent material 14 including the activated carbon or the like. Therefore, when the removal agent is used as the deterioration prevention material 23, the removal agent is preferably disposed in the vicinity of the port 12 in the interior of the cabinet 21. Specifically, the removal agent is disposed at a position such that the port 12 in the interior of the cabinet 21 is closer to the removal agent than the cartridge 13. Thus, even if gas external of the cabinet 21 flows in from the port 12 when the speaker device is in operation, most of the gas will pass in the vicinity of the deterioration prevention material 23. That is, the removal agent can adsorb organic gas contained in the gas before the organic gas reaches the adsorbent material 14. Note that the aforementioned drying agent such as silica gel has a characteristic that adsorbs moisture more easily than the adsorbent material 14. Therefore, the drying agent may be disposed anywhere in the interior of the cabinet 21. However, similarly to the removal agent, if the drying agent is disposed in the vicinity of the port 12, the drying agent can more effectively adsorb gas which causes deterioration of the adsorbent material 14.

Figure 8:
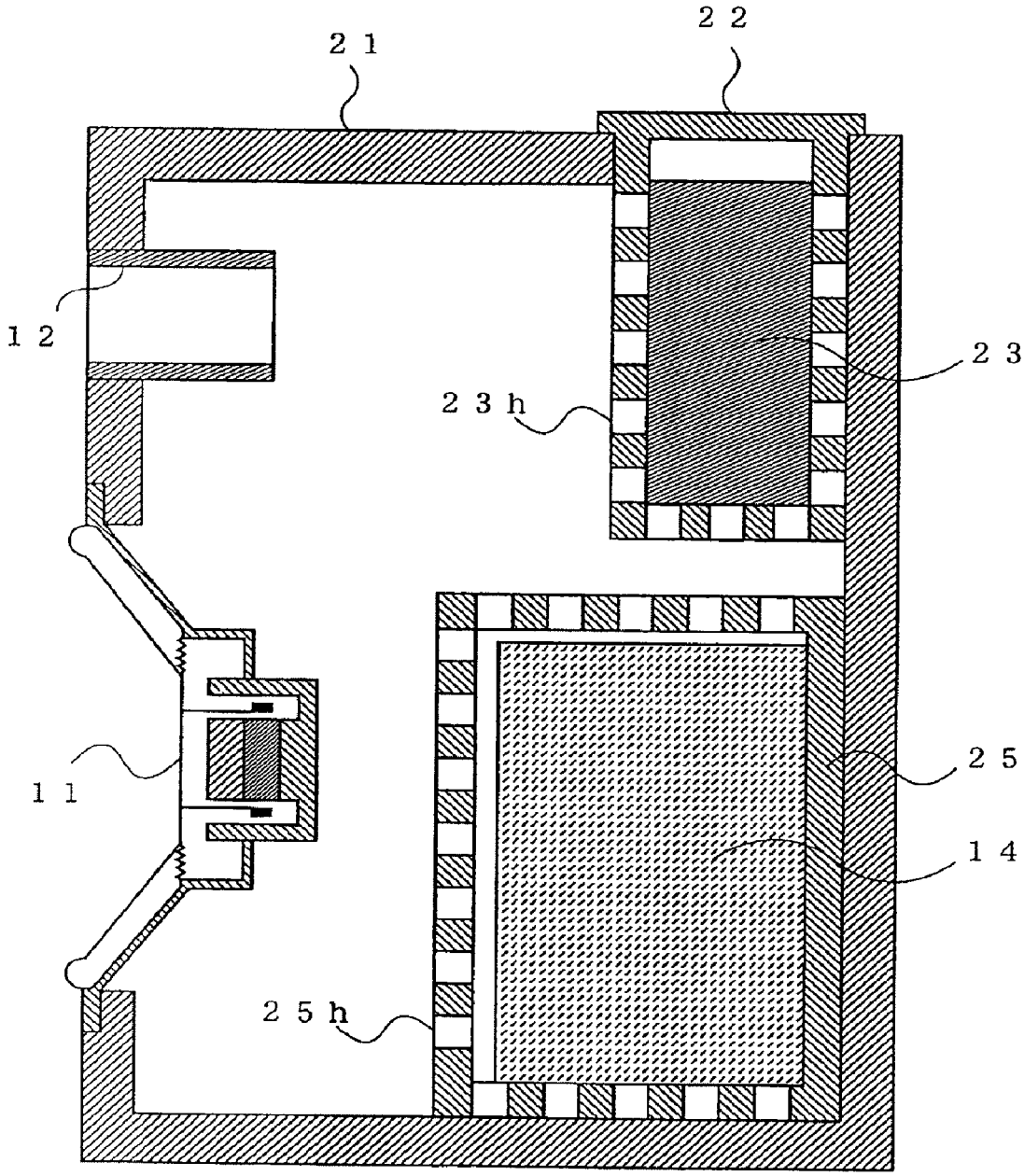
FIG. 8 is a cross-sectional view illustrating a speaker device in which no adsorbent material 14 is disposed in a removable cartridge 13 in a case where a deterioration prevention material cartridge 22 is provided.

As shown in FIG. 8, in the case where the deterioration prevention material cartridges 22 or 24 is provided, a certain effect can be obtained even if no adsorbent material 14 is disposed in the interior of the removable cartridge 13. FIG. 8 is a cross-sectional view illustrating a speaker device in which no adsorbent material 14 is disposed in the removable cartridge 13 in the case where the deterioration prevention material cartridge 22 is provided. The adsorbent material 14 is disposed in the interior of a container 25. A plurality of air holes **25*h* for passing air between the interior of the container 25 and the interior of the cabinet 21 are formed through the container 25. In this case, the adsorbent material 14 cannot be replaced or reactivated. However, the deterioration prevention material 23 can be replaced or reactivated, thereby making it possible to suppress deterioration of the adsorbent material 14** over a long period of time.

Third Embodiment

Figure 9:
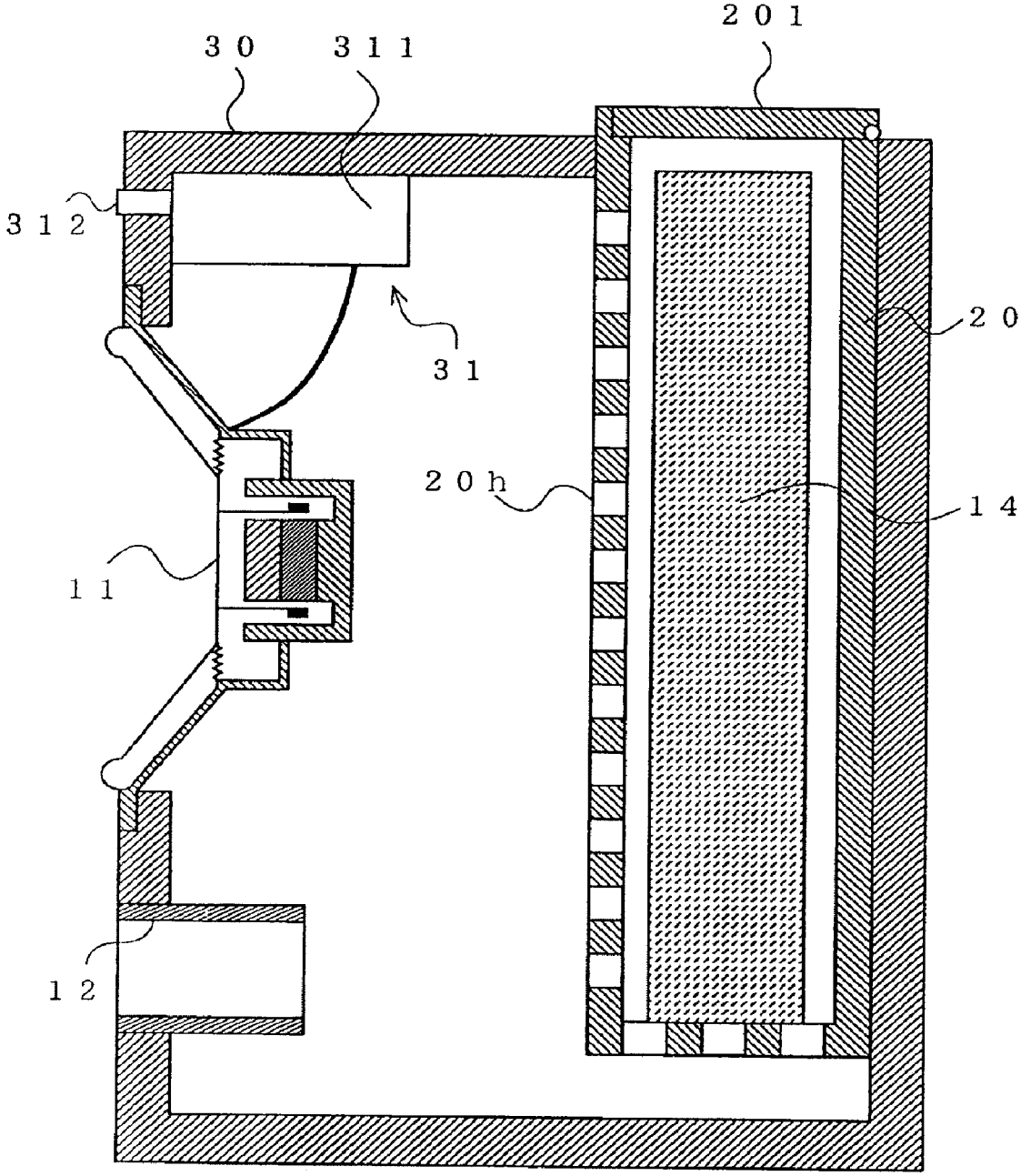
FIG. 9 is a cross-sectional view illustrating a structure of a speaker device according to a third embodiment.

A speaker device according to a third embodiment of the present invention will be described with reference to FIG. 9. FIG. 9 is a cross-sectional view illustrating a structure of a speaker device according to the third embodiment. In FIG. 9, the speaker device includes a cabinet 30, the speaker unit 11, the port 12, the cartridge 20, and the adsorbent material 14, and a deterioration detection device 31. The speaker unit 11, the port 12, the cartridge 20, and the adsorbent material 14 have the same functions as the respective elements described in the first embodiment. Thus, like reference numerals will be denoted and detailed descriptions thereof will be omitted. The speaker device of the present embodiment is different from the speaker device of the first embodiment described above in that the speaker device of the present embodiment further includes the deterioration detection device 31. Hereinafter, the present embodiment will be described mainly with respect to this difference.

The deterioration detection device 31 is mounted in the interior of the cabinet 30. The deterioration detection device 31 has measurement means 311 and notification means 312. The measurement means 311 inputs to the speaker unit 11 a signal or white noise, which sweeps from a low frequency to a high frequency, and measures a frequency response of electrical impedance of the speaker unit 11. The notification means 312 is disposed so as to be exposed to the exterior of the cabinet 30. Then, the notification means 312 notifies a user that a peak value of the frequency response measured by the measurement means 311 has been shifted to the high frequency side by a predetermined frequency. In the case where the notification means 312 includes a LED (Light Emitting Diode), for example, it is possible to notify the user by the LED turning on.

Described next is an operation of the deterioration detection device 31. As time elapses, the adsorbent material 14 adsorbs moisture or organic gas, and deteriorates. As such, because the effect of physical adsorption provided by the adsorbent material 14 becomes reduced, a bass reproduction limit of the speaker device is to be shifted to the high frequency side. When the bass reproduction limit is shifted to the high frequency side, the frequency response of the electrical impedance of the speaker unit 11 is also to be shifted to the high frequency side. The measurement means 311 of the deterioration detection device 31 inputs to the speaker unit 11 the signal or the white noise, which sweeps from the low frequency to the high frequency, and measures the frequency response of the electrical impedance of the speaker unit 11. Then, the notification means 312 notifies the user that the peak value of the frequency response measured by the measurement means 311 has been shifted to the high frequency side by the predetermined frequency. In the case where the notification means 312 includes the LED, the LED turns on. As a method for driving the deterioration detection device 31, for example, an input button is provided on the exterior of the cabinet 30, whereby a user pushes the input button at a preferred time so as to drive the deterioration detection device 31. Alternatively, there may be another method for driving the deterioration detection device 31, for example, by remote control by a remote control or the like.

As described above, the deterioration detection device 31 is provided in the speaker device, thereby allowing the user to easily recognize that the adsorbent material 14 has been deteriorated. That is, the user can easily understand a time to replace the cartridge 20 or a time to reactivate the adsorbent material 14.

In the above description, the notification means 312 is the LED. However, a sound (a recorded message or a beep sound, for example) may be used for notifying the user. The notification means 312 replays the sound, and notifies the user of deterioration of the adsorbent material 14. Furthermore, the cabinet 30 may be any type including a bass-reflex type, a closed enclosure type, and a drone cone type. Still furthermore, in the above description, the deterioration detection device 31 is mounted in the interior of the cabinet 30. However, the deterioration detection device 31 may be mounted on the exterior of the cabinet.

Fourth Embodiment

A speaker device according to a fourth embodiment of the present invention will be described with reference to FIG. 10.

Figure 10:
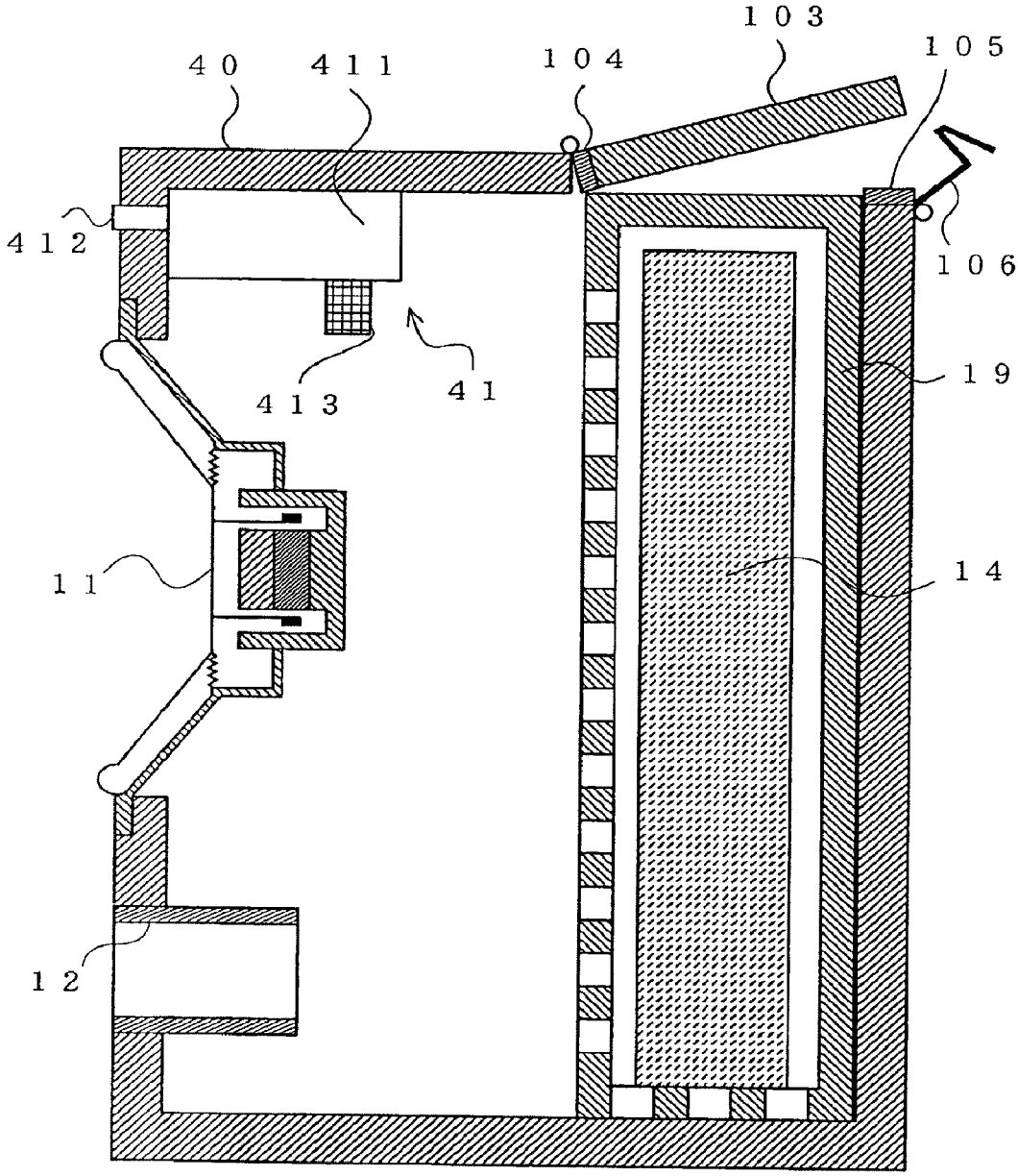
FIG. 10 is a cross-sectional view illustrating a structure of a speaker device according to a fourth embodiment.

FIG. 10 is a cross-sectional view illustrating a structure of a speaker device according to the fourth embodiment. In FIG. 10, the speaker device includes a cabinet 40, the speaker unit 11, the port 12, the cartridge 19, the adsorbent material 14, and a deterioration detection device 41. Note that the cabinet 40 includes the elastic bodies 104 and 105, the opening and closing part 103, and the fixing tool 106, which are the same as those described in the first embodiment above. Thus, like reference numerals will be denoted and detailed descriptions thereof will be omitted. Furthermore, the speaker unit 11, the port 12, the cartridge 19, and the adsorbent material 14 are the same as the respective elements described in the first embodiment. Thus, like reference numerals will be denoted and detailed descriptions thereof will be omitted. The speaker device of the present embodiment is different from the speaker device of the first embodiment described above in that the speaker device of the present embodiment further includes the deterioration detection device 41. Hereinafter, the present embodiment will be described mainly with respect to this difference.

The deterioration detection device 41 is mounted in the interior of the cabinet 40. The deterioration detection device 41 has measurement means 411 and notification means 412. The measurement means 411 has a microphone 413. The measurement means 411 inputs to the speaker unit 11 a signal or white noise, which sweeps from a low frequency to a high frequency, and measures a sound pressure frequency response of the interior of the cabinet 40. The notification means 412 is disposed so as to be exposed to the exterior of the cabinet 40. Then, the notification means 412 notifies a user that a bass reproduction limit of the sound pressure frequency response measured by the measurement means 411 has been shifted to the high frequency side by a predetermined frequency. In the case where the notification means 412 includes an LED (Light Emitting Diode), for example, it is possible to notify the user by the LED turning on.

Described next is an operation of the deterioration detection device 41. As time elapses, the adsorbent material 14 adsorbs moisture or organic gas, and deteriorates. As such, because the effect of physical adsorption provided by the adsorbent material 14 becomes reduced, the bass reproduction limit of the speaker device is to be shifted to the high frequency side. The measurement means 411 of the deterioration detection device 41 inputs to the speaker unit 11 the signal or the white noise, which sweeps from the low frequency to the high frequency, and measures the sound pressure frequency response of the interior of the cabinet 40 by means of the microphone 413. The notification means 412 notifies the user that the bass reproduction limit of the sound pressure frequency response measured by the measurement means 411 has been shifted to the high frequency side by the predetermined frequency. In the case where the notification means 412 includes the LED, the LED turns on. As a method for driving the deterioration detection device 41, for example, an input button is provided on the exterior of the cabinet 40, whereby a user pushes the input button at a preferred time so as to drive the deterioration detection device 41. Alternatively, there may be another method for driving the deterioration detection device 41, for example, by remote control by means of a remote control or the like.

As described above, the deterioration detection device 41 is provided in the speaker device, thereby allowing the user to easily recognize that the adsorbent material 14 has been deteriorated. Thus, the user can easily understand a time to replace the cartridge 19 or a time to reactivate the adsorbent material 14.

In the above description, the notification means 411 is the LED. Similarly to the aforementioned third embodiment, a sound may be used for notifying the user. The notification means 411 replays the sound, and notifies the user of deterioration of the adsorbent material 14. Furthermore, the cabinet 40 may be any type including a bass-reflex type, a closed enclosure type, and a drone cone type. Still furthermore, in the above description, the deterioration detection device 41 is mounted in the interior of the cabinet 40. However, the deterioration detection device 41 may be mounted on the exterior of the cabinet. In this case, the microphone 413 may be mounted on the exterior of the cabinet 40. In the case where the microphone 413 is mounted on the exterior of the cabinet 40, the microphone 413 measures the sound pressure frequency response of the exterior of the cabinet 40.

Figure 11:
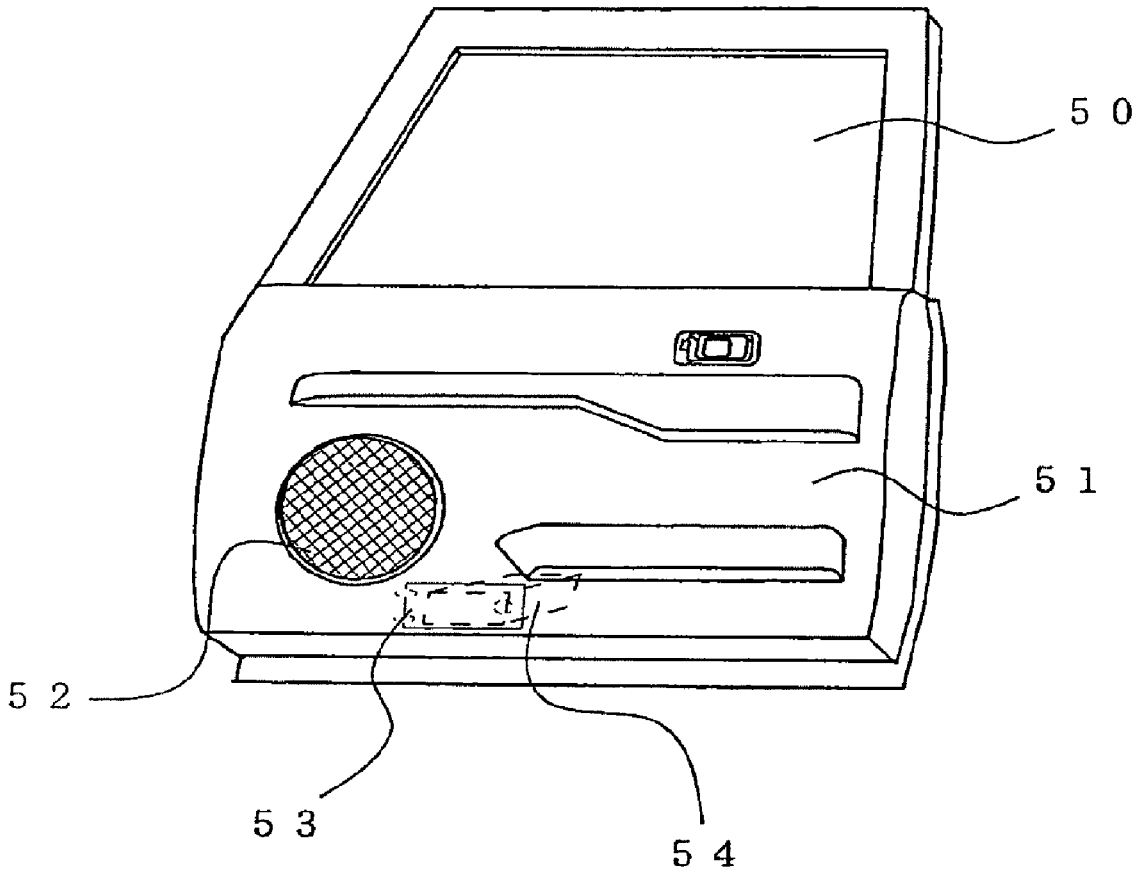
FIG. 11 is a view illustrating an example in which a cartridge 54 is mounted in a door of a vehicle.

The speaker device according to the aforementioned first to fourth embodiments is mounted in the interior of a vehicle body, for example. As an example of such, the speaker device is mounted in a door of the vehicle. FIG. 11 is a view illustrating an example in which a cartridge 54 is mounted in the door of the vehicle.

In FIG. 11, the door of the vehicle includes a window part 50, a door body 51, a speaker unit 52, an opening and closing part 53, and the cartridge 54. A space is formed in the interior of the door body 51. The speaker unit 52 is the same as the speaker unit 11, and is attached to the interior of the door body 51. The cartridge 54 has the same structure as that of the cartridge 19, and is disposed in the interior of the door body 51. The opening and closing part 53 is disposed in the door body 51 so as to open and close, thereby allowing the cartridge 54 to be inserted into and extracted from the opening and closing part 53. When an adsorbent material provided in the cartridge 54 is deteriorated, the cartridge 54 can be replaced with another new cartridge. Or the adsorbent material can be reactivated. Note that the door body 51 is operable to function as a cabinet of the speaker unit 52. Thus, the speaker device includes the speaker unit 52, the door body 51, the opening and closing part 53, and the cartridge 54.

As described above, by mounting the cartridge 54 in the door of the vehicle, it becomes possible to provide an in-vehicle listening environment capable of extending the bass reproduction range over a long period of time even if the cartridge 54 is mounted in the door body 51 which is the same as the conventional art.

In the in-vehicle environment, temperature changes dramatically and humidity is high as compared to in a house. There may be a case where the interior of a vehicle is filled with smoke from a cigarette or the like. Under such an in-vehicle environment, the adsorbent material is more likely to deteriorate. Thus, it is difficult to maintain a bass reproduction ability. However, in the present invention, the adsorbent material is provided so as to be removable from a door of a vehicle, thereby making it possible to maintain a bass reproduction ability over a long period of time.

Furthermore, because the interior of the door body 51 includes a window glass storage part, a window glass automatic open and close mechanism, a door lock, a wire, a control circuit, and the like, an internal volume is limited. Even if the speaker device is mounted in the door of the vehicle in which such an internal volume is limited, it is possible to provide reproduction having the bass reproduction range which is extended as compared to the conventional art.

Note that the aforementioned opening and closing part 53 and cartridge 54 are any of the cartridges described in the first embodiment. Furthermore, the door body 51 may further include the deterioration prevention material 22 or 24, and the deterioration detection device 31 or 41, which are described in the second to fourth embodiments.

Figure 12:
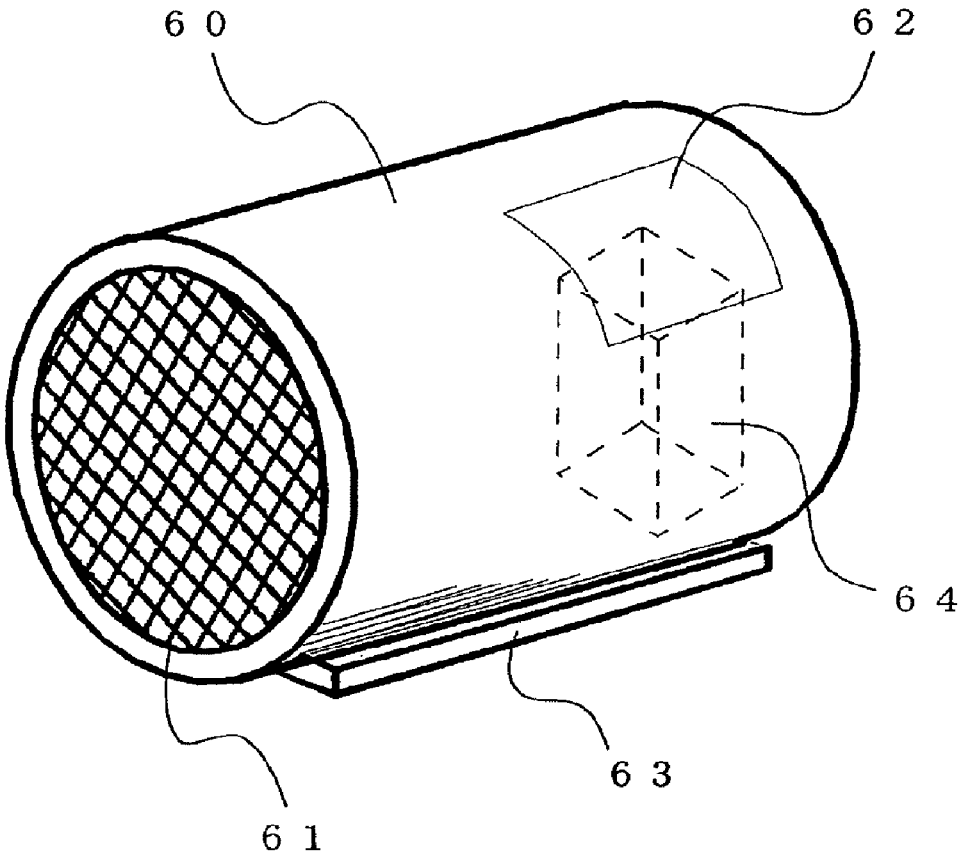
FIG. 12 is a view illustrating another example in which a speaker device is mounted in the interior of a vehicle.

Alternatively, the speaker device according to the aforementioned first to fourth embodiments may be an in-vehicle speaker device mounted in the interior of a vehicle body shown in FIG. 12. FIG. 12 is a view illustrating another example in which the speaker device is mounted in the interior of the vehicle. In FIG. 12, the speaker device includes a cabinet 60, a speaker unit 61, an opening and closing part 62, a base 63, and a cartridge 64. The cabinet 60 has a cylindrical shape. The speaker unit 61 is the same as the speaker unit 11, and is attached to the cabinet 60. The cartridge 64 is the same as the cartridge 19, and is mounted in the interior of the cabinet 60. The opening and closing part 62 is disposed in the cabinet 60 so as to open and close, thereby allowing the cartridge 64 to be inserted into and extracted from the opening and closing part 62. When an adsorbent material provided in the cartridge 64 is deteriorated, the cartridge 64 can be replaced with another new cartridge. Or the adsorbent material can be reactivated. As described above, by mounting the speaker device shown in FIG. 12 in the vehicle, it becomes possible to provide an in-vehicle listening environment capable of extending a bass reproduction range over a long period of time.

As described above, the in-vehicle environment is harsh as compared to in the house. Under such an environment, the adsorbent material is more likely to deteriorate. Thus, it is difficult to maintain the bass reproduction ability. However, in the present invention, the adsorbent material is provided so as to be removable from the speaker device, thereby making it possible to maintain a bass reproduction ability over a long period of time.

When the bass reproduction range having the same level as the conventional speaker device can be obtained, the size of the speaker device can be smaller than that of the conventional speaker device including no adsorbent material. Therefore, with the speaker device mounted in the interior of the vehicle, more space can be saved therein. Furthermore, in a speaker device for reproducing bass sound such as a sub woofer, it is particularly effective because the speaker device for reproducing bass sound generally requires a large volume cabinet.

Note that a shape of the cabinet 60 is not limited to a cylindrical shape. The cabinet 60 may have a rectangular parallelepiped shape. Furthermore, the aforementioned opening and closing part 62 and cartridge 61 are any of the cartridges described in the first embodiment. Still furthermore, the speaker device may further include the deterioration prevention material cartridge 22 or 24, and the deterioration detection device 31 or 41, which are described in the second to fourth embodiments.

The speaker device according to the aforementioned first to fourth embodiments is mounted in an audiovisual system, for example. As an example of such, the speaker device according to the aforementioned first to fourth embodiments is mounted in a video device (e.g., a cathode-ray tube television, a liquid crystal television, a plasma television, or the like).

Figure 13:
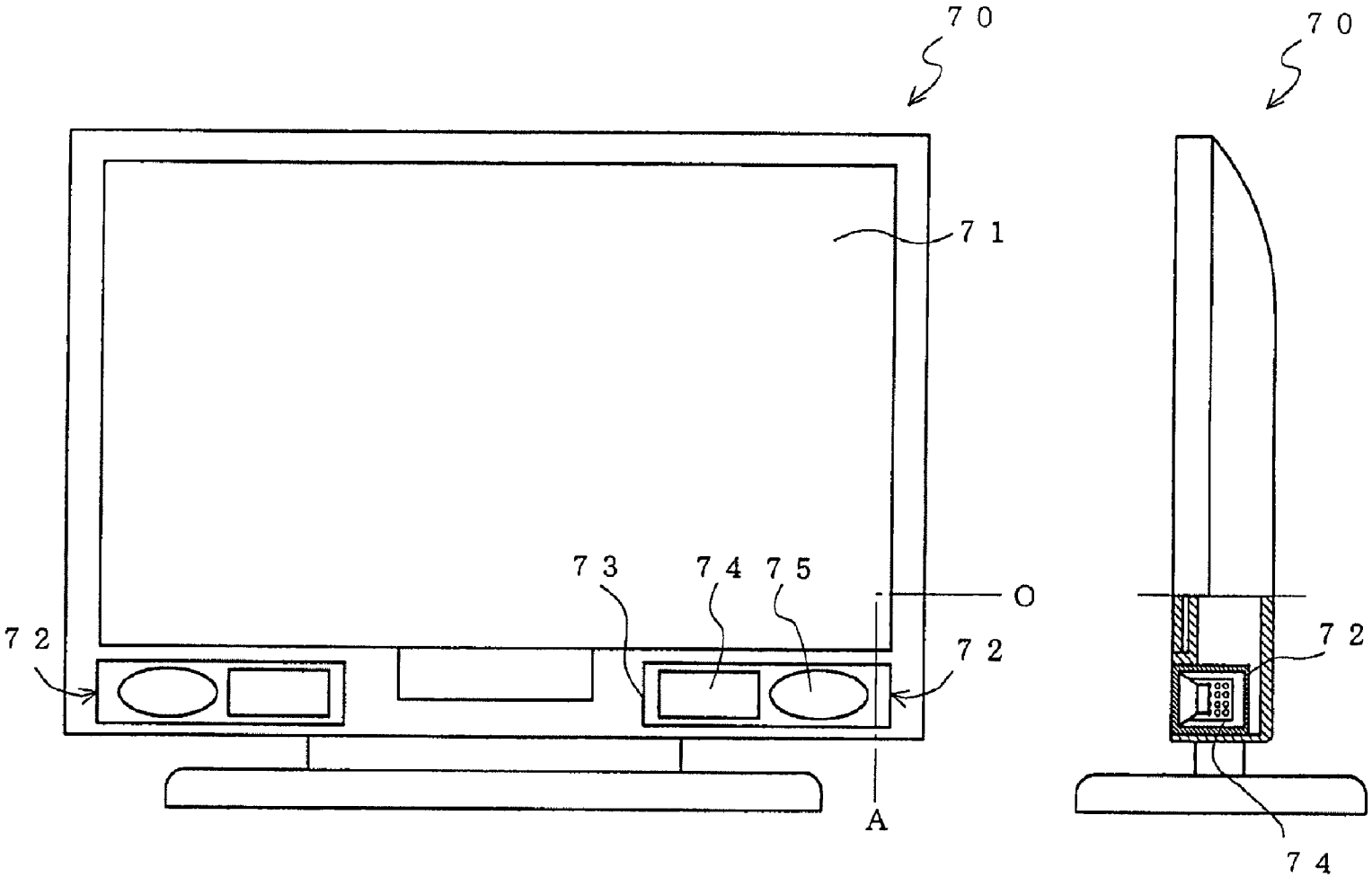
FIG. 13 is a view illustrating an exemplary structure of the speaker device mounted in a slim television.
Figure 14:
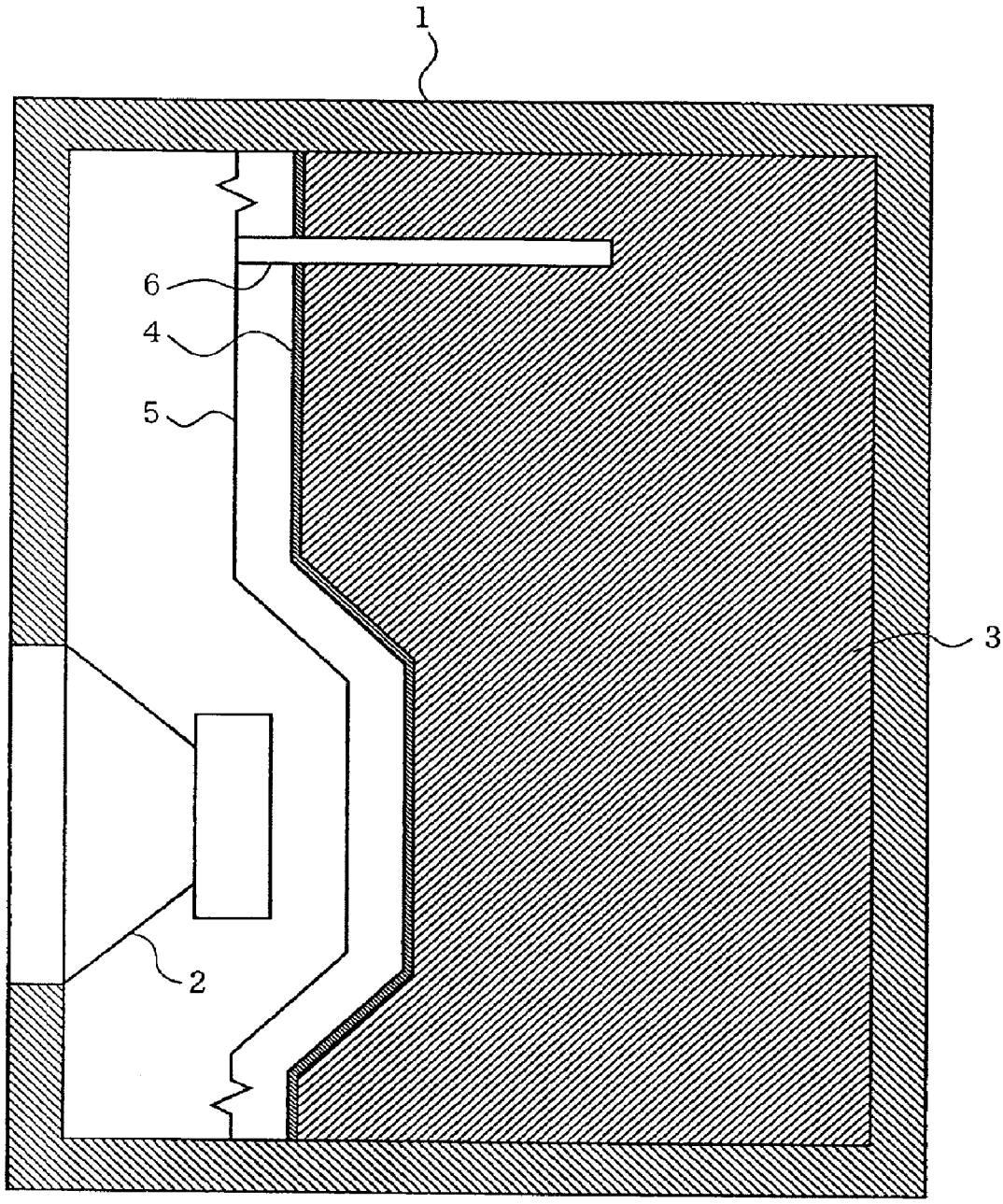
FIG. 14 is a cross-sectional view illustrating a structure of a main potion of a conventional speaker device.

FIG. 13 is a view illustrating an exemplary structure of the speaker device mounted in a slim television. FIG. 13 shows a front view of the slim television and a side view thereof illustrating a cross-sectional view of a portion of the slim television, along lines OA of the front view. In FIG. 13, the slim television includes a slim television body 70, a display 71, and two speaker devices 72. Each of the speaker devices 72 is any of the speaker devices described in the first to fourth embodiments. Here, it is assumed that each speaker device 72 includes a cabinet 73, a cartridge 74, and a speaker unit 75. The cartridge 74 is any of the cartridges described in the first embodiment. The speaker unit 75 has an elliptical shape, for example.

The cabinet 73 of the speaker device 72 is disposed in the interior of a housing provided in the lower portion of the display 71. The speaker unit 75 is mounted in the cabinet 73. The cartridge 74 is disposed at a position so as to be removable from the exterior of the slim television body 70. When an adsorbent material provided in the cartridge 74 is deteriorated, the cartridge 74 can be replaced with another new cartridge. Or the adsorbent material can be reactivated. As described above, by mounting the speaker device according to the present invention in the slim television body 70, it becomes possible to provide the slim television body 70 capable of extending a bass reproduction range over a long period of time.

Furthermore, when the slim television body 70 can obtain the bass reproduction range having the same level of the conventional speaker device which includes no adsorbent material, the size of the cabinet 73 of the speaker device 72 can be smaller than that of the conventional speaker device. Therefore, in the case where a problem lies in a space for mounting the speaker device when the size or the thickness of the slim television body 70 is further reduced, the size or the thickness of the slim television body 70 can be reduced by mounting the speaker device 72 in the slim television.

The above description illustrates an example where the cabinets 73 shown in FIG. 13 are displaced in the interior of the housing provided in the lower portion of the display 71.

However, the cabinets 73 may be disposed on right and left sides of the display 71, respectively. Furthermore, the speaker device may further include the deterioration prevention material cartridge 22 or 24, and the deterioration detection device 31 or 41, which are described in the second to fourth embodiments.

INDUSTRIAL APPLICABILITY

A speaker device according to the present embodiment is capable of performing bass reproduction even using a compact cabinet volume, and is applicable to a liquid crystal television, a PDP (a plasma display), a stereo device, a5.1 channel home theater speaker, a speaker for vehicle, and the like.

The invention claimed is:

1. A speaker device comprising:

a cabinet;

a speaker unit attached to the cabinet;

a first container removably attached to a first opening formed in the cabinet;

an adsorbent material disposed in an interior of the cabinet; and a measurement device for measuring a characteristic of an electrical impedance of the speaker unit;

wherein the adsorbent material is adapted and arranged to acoustically expand a volume of the interior of the cabinet by physical adsorption of the adsorbent material;

wherein an air hole for passing air between an interior of the first container and the interior of the cabinet extends through the first container; and wherein the measurement device is operable to detect deterioration of the adsorbent material based on a change in the characteristic of the electrical impedance of the speaker unit.

2. The speaker device according to claim 1, wherein the adsorbent material is at least one material selected from a group of materials consisting of an activated carbon, a carbon nanotube, and a fullerene.

3. The speaker device according to claim 1, wherein the adsorbent material is disposed in the interior of the first container.

4. The speaker device according to claim 1, further comprising a deterioration prevention material disposed in the interior of the first container, the deterioration prevention material being adapted and arranged to prevent deterioration of the adsorbent material by adsorbing, absorbing, or chemically reacting to gas that causes deterioration of the adsorbent material.

5. The speaker device according to claim 4, wherein the deterioration prevention material is at least one material selected from a group of materials consisting of an activated carbon, zeolite, diatomite, chitosan, and catechin.

6. The speaker device according to claim 4, further comprising a port for allowing air to pass between the interior and an exterior of the cabinet, wherein the first container is disposed at a position within the interior of the cabinet, the position being closer to an opening of the port than to the adsorbent material.

7. The speaker device according to claim 6, wherein the first container is disposed within an interior of the port.

8. The speaker device according to claim 1, wherein a heat resistant temperature of the first container is higher than or equal to a boiling point of a substance adsorbed into the deterioration prevention material.

9. The speaker device according to claim 1, further comprising:

a shock-absorbing member disposed at an attachment portion of the first container, the shock-absorbing member being adapted and arranged to attach the first container to the cabinet; and a fixing tool mounted on the cabinet, the fixing tool being adapted and arranged to fix the first container thereto such that the first container presses against the cabinet through the shock-absorbing member.

10. The speaker device according to claim 1, further comprising:

a shock-absorbing member disposed on an inner face of the cabinet, and a fixing tool for fixing the first container thereto such that the first container presses against the inner face of the cabinet through the shock-absorbing member.

11. The speaker device according to claim 1, wherein the first container includes an opening-and-closing part for opening and closing an opening formed in the first container.

12. The speaker device according to claim 1, wherein the cabinet includes an opening-and-closing part for opening and closing the first opening, and the first container is disposed in the interior of the cabinet.

13. The speaker device according to claim 1, further comprising a notification device for providing a notification that a peak value of the electrical impedence is shifted to a high frequency side by a predetermined frequency.

14. A vehicle comprising:

the speaker device of claim 1; and a vehicle body with the speaker device disposed in an interior thereof.

15. A video device comprising:

the speaker device of claim 1; and a device housing with the speaker device disposed in an interior thereof.

16. A speaker device comprising:

a cabinet;

a speaker unit attached to the cabinet;

a first container removably attached to a first opening formed in the cabinet;

an adsorbent material disposed in an interior of the cabinet;

a measurement device for measuring a sound pressure frequency response of the speaker unit; and a notification device for providing a notification that a bass reproduction limit of the sound pressure frequency response is shifted to a high frequency side by a predetermined frequency;

wherein the adsorbent material is adapted and arranged to acoustically expand a volume of the interior of the cabinet by physical adsorption of the adsorbent material;

wherein an air hole for passing air between an interior of the first container and the interior of the cabinet extends through the first container; and wherein the measurement device is operable to detect deterioration of the adsorbent material based on a change in the characteristic of the electrical impedance of the speaker unit.

* * * * *